US009792771B2

(12) United States Patent
Khal

(10) Patent No.: US 9,792,771 B2
(45) Date of Patent: Oct. 17, 2017

(54) BINGO GAMING SYSTEM AND METHOD

(71) Applicant: Zaki Khal, Henderson, NV (US)

(72) Inventor: Zaki Khal, Henderson, NV (US)

( * ) Notice: Subject to any disclaimer, the term of this patent is extended or adjusted under 35 U.S.C. 154(b) by 732 days.

(21) Appl. No.: 14/084,114

(22) Filed: Nov. 19, 2013

(65) Prior Publication Data

US 2014/0080567 A1 Mar. 20, 2014

Related U.S. Application Data

(63) Continuation-in-part of application No. 12/862,318, filed on Aug. 24, 2010, now Pat. No. 8,715,057, and a continuation-in-part of application No. 12/862,304, filed on Aug. 24, 2010, now Pat. No. 8,740,686.

(60) Provisional application No. 61/236,352, filed on Aug. 24, 2009.

(51) Int. Cl.
*A63F 3/06* (2006.01)
*G07F 17/32* (2006.01)

(52) U.S. Cl.
CPC ..... *G07F 17/329* (2013.01); *A63F 3/062* (2013.01); *A63F 3/0645* (2013.01)

(58) Field of Classification Search
CPC ..... G07F 17/329; A63F 3/06; A63F 3/062; A63F 3/0605; A63F 3/0645
See application file for complete search history.

(56) References Cited

U.S. PATENT DOCUMENTS

2005/0059471 A1* 3/2005 Cannon ..... G07F 17/3267 463/19

* cited by examiner

*Primary Examiner* — Damon Pierce
(74) *Attorney, Agent, or Firm* — Weide & Miller, Ltd.

(57) ABSTRACT

A system or method for providing a bingo game in which a pattern of player indicia on a player card is matched to house indicia selected during the game. The system or method includes providing a first player card of a plurality of player cards that each include a plurality of player indicia and a pattern that includes at least a portion of the player indicia, using a device to randomly select a plurality of house indicia, determining whether a triggering criterion is met during the bingo game, and awarding a prize for each player card that achieves a partial pattern match with the selected house indicia upon the determination that the triggering criterion has been met. The partial pattern match is achieved by matching the selected house indicia with a predetermined number of player indicia, but not all of the player indicia, within the pattern.

18 Claims, 4 Drawing Sheets

| Ball Calls | Prize |
|---|---|
| 48 or less | 100.000 |
| 49 exactly | 50.000 |
| 50 exactly | 25.000 |
| 51 exactly | 10.000 |
| 52 exactly | 5.000 |
| 53 exactly | 4.000 |
| 54 exactly | 3.000 |
| 55 exactly | 2.000 |

| Ball Calls | | Prize |
|---|---|---|
| 48 | or less | 100,000 |
| 49 | exactly | 50,000 |
| 50 | exactly | 25,000 |
| 51 | exactly | 10,000 |
| 52 | exactly | 5,000 |
| 53 | exactly | 4,000 |
| 54 | exactly | 3,000 |
| 55 | exactly | 2,000 |

BINGO GAMING SYSTEM AND METHOD

CROSS-REFERENCE TO RELATED APPLICATIONS

This application is a continuation-in-part of U.S. Non-Provisional application Ser. No. 12/862,318 filed Aug. 24, 2010 and titled "Multi-Win Bingo Gaming System and Method," and is a continuation-in-part of U.S. Non-Provisional application Ser. No. 12/862,304 filed Aug. 24, 2010 and titled "Primary or Secondary Multi-Win Bingo Wagering System and Method," both of which claim the benefit of U.S. Provisional Application Ser. No. 61/236,352 filed Aug. 24, 2009 and titled "Bingo Game With Multiple Prizes And Winners," the disclosures of which are hereby incorporated by reference in their entirety.

BACKGROUND

Embodiments of the present disclosure relate to a gaming system and method for playing bingo and related games with multiple prizes and/or winners.

Bingo is a game of chance played with randomly drawn articles typically having numbers that players match against numbers often prearranged in a table, grid, matrix, or array, generally referred to as faces, to make a predetermined winning pattern. The numbers may be printed on paper or cardstock, or electronically represented on a display with the subset of numbers for each play generally referred to as cards or tickets. When a single paper or other playing piece includes multiple cards, each may be referred to as a card face with the group of card faces referred to as a card or ticket. Players try to obtain the winning pattern or number of matches on their faces by covering or marking numbers on their cards as numbers are randomly selected from a predetermined group of numbers, such as 75 or 90 numbers, for example. Once a winning pattern or number is achieved, the game ends. There is no minimum number of selected numbers required to end the game beyond the minimum number of calls necessary to complete the pattern or number in the winning criterion.

Traditional bingo and related games generally conclude the game when the first person achieves a specified winning pattern using the randomly selected or called numbers. The winner is usually required to call out the word "Bingo!" which alerts the other players and game supervisor or caller of a possible winner. Wins are generally checked for accuracy before the win is officially confirmed at which time the prize is secured and a new game is begun. In computerized systems, a win may be confirmed or validated by a computer using a security code or other identifier contained on each card. In this version of bingo, players compete against one another for the prize or jackpot.

Although regulations for bingo and related games vary considerably by jurisdiction, the regulations generally include some requirement that the game must be played to conclusion. This requirement is generally interpreted as requiring a winner or winners. As such, if there are no winners in the prescribed number of calls, players continue to play for a consolation prize. The operator continues to draw balls until someone achieves the winning combination. The consolation prize paid to the next player that achieves the winning pattern or combination. As the number of balls called approaches the total number of available balls, there will inevitably be a winner.

Consolation prizes may be a fixed amount or a pari-mutuel prize based on the total or aggregate number and price of cards or tickets purchased by all players for that game. Payment of consolation prizes may be a significant operating expense for bingo gaming establishments. In addition, because of the uncertainty in the number of calls that may be required for a consolation prize winner, the use of consolation prizes to meet the requirement that the game be played to conclusion may reduce the total number of games that can be played in a given time period and thereby adversely affect scheduling of games and overall revenue for the operator.

Alternative methods of play have been developed to increase participation by creating excitement. Since its invention in 1934, modern bingo has evolved into multiple variations, with each jurisdiction's gambling laws regulating how the game is played. There are also nearly unlimited patterns that may be specified for play. Some patterns only require one number to be matched whereas cover-all games require an entire card to be matched or covered to award the jackpot. Other games may award prizes to players for matching no numbers or achieving none of the specified patterns.

There are many variations of bingo games and even bingo cards. For example, double-action cards have two numbers in each square. However, the most common bingo cards are flat pieces of cardboard or disposable paper that contain 25 squares arranged in five vertical columns and five horizontal rows. Each space in the grid contains a single number, except there may be one or more "Free" spaces, which typically include at least the center space. The "Free" spaces are considered covered or filled from the beginning of the game. For games played utilizing 75 numbers or another multiple of 5 numbers, the letters B, I, N, G, O may be pre-printed above the five vertical columns with one letter appearing above each column to assist players in more quickly locating a called number on their card(s). Players often play multiple cards for each game. For 75 number games, the numbers printed on the card are commonly arranged as follows: 1 to 15 in the B column; 16 to 30 in the I column; 31 to 45 in the N column; 46 to 60 in the G column and 61 to 75 in the 0 column. Depending on how many numbers are in each column for a particular game, the numbers are generally randomly selected from the number ranges above for each column. For example, a standard bingo game may include 25 spaces with 5 randomly selected numbers between 1 and 15 assigned to the B column, and so on. However, one variation randomly assigns the numbers to the available columns. In another variation, sometimes referred to as "U-Pick'Em" bingo, players may be issued three cards each having ⅓ of the total available numbers with all numbers that may be called or drawn included. Players then identify or mark which numbers they wish to play and then cover or mark the selected numbers when a corresponding number is called or drawn. Rather than a predetermined pattern, a predetermined number (such as 5 or 10) of matches to the called numbers determines a winning card.

Various patterns may be used to determine a winner for a particular game. In addition to a straight horizontal, vertical, or diagonal line, many bingo halls consider other patterns as a valid bingo, usually in special games. For example, a 2×2 square in the upper right-hand corner would be considered a "postage stamp". Another common special game requires players to cover each of the four corner squares. Games may also require two lines (double) or three lines (triple) to win. Combination games may have multiple bingos and/or winners based on different winning patterns or criteria. For example, the players first play to achieve a first winning pattern, such as a single line, to determine a first winner and then continue playing with the same cards and numbers to achieve a second winning pattern, such as a double line or coverall for another prize.

The called numbers may be randomly selected using various methods for any of the variations of the game. With the expansion of computer technology, electronic random number generators are now commonplace in many jurisdictions. However, some jurisdictions require mechanical ball draws that may utilize a randomly shuffled deck of bingo calling cards, a mechanical ball blower that mixes ping-pong balls with blown air, or a cage that is turned to mix small wooden balls. All methods essentially generate a random string of numbers for players to match to their bingo cards.

In another version of play sometimes referred to as "Quick Shot", numbers are pre-drawn and players purchase sealed bingo cards that are then matched against the pre-drawn numbers. If a specified pattern is achieved, then the player usually wins a prize according to a prize table. Some versions are played until a player achieves a top level prize, and then new numbers are drawn and the game begins anew. This type of bingo may be played over days, weeks, or months depending on the difficulty of achieving a top level prize.

In "Bonanza Bingo" played with 75 numbers, typically 43 numbers are pre-drawn at the beginning of a bingo session. Players purchase sealed cards that are then matched against the pre-drawn numbers. At a designated time, the caller asks if anyone has a winning pattern or bingo. If no winners are identified, the caller then draws one more ball. This game is commonly played as a "progressive" game, where the jackpot increases as more cards are sold. If no one has achieved bingo after the single ball has been drawn, players then hold their cards for the next session of bingo, which may take, place the following day or following week. During each session thereafter, a single ball is drawn and players may continue to purchase additional sealed cards until someone achieves a cover-all. This version of bingo awards prizes to players who do not have a single number matched from the initial numbers drawn.

Many bingo gaming establishments have a call board or flashboard with called numbers illuminated for the players to see previously called numbers. In U.S. style bingo using 75 numbers, the flashboard is often arranged in 5 rows of 15 columns with the numbers arranged in sequence from left to right. In a version referred to as "Horse Racing Bingo" up to 15 players are randomly issued a number from 1 to 15 corresponding to the top row of numbers on the flashboard. Numbers are then drawn and the first person to match all five numbers in their assigned column wins. This is a fast paced and exciting form of bingo typically played in fraternal organizations.

With the expansion of Tribal gaming across the U.S., there are numerous versions of bingo that emulate the fast action of casino like table games, but utilize the principals of bingo where players mark and monitor grid or matrix cards with chips. Casino games like Roulette, Acey Duecy, and Money Wheel have bingo counterparts, which are permitted to be played under bingo licenses in many parts of the country.

There are several differences between European (or U.K.) style bingo and U.S. style bingo, including the cards, pool of numbers, and winning combinations, for example. European style bingo is generally played by selecting numbers from a group of 90 articles or elements that are numbered from 1 to 90, rather than the 75 numbers used in U.S. style bingo. A typical bingo ticket or card is arranged in a grid having nine columns and three rows. Rather than having a number in each square of the grid, each row contains five numbers and four blank spaces. The numbers and blank spaces are arranged so that each column contains at least one number. The numbers are generally assigned with the first column containing numbers from 1 to 9, the second column containing numbers from 10 to 19, the third column containing numbers from 20 to 29 and so on up until the last column, which contains numbers from 80 to 90. Winning patterns or combinations generally include a horizontal line, two lines, or a full house, which is similar to a coverall as all fifteen numbers on the ticket are covered.

In New Zealand bonus games (Super Housie), often three lines may be claimed—top, middle and bottom. In the UK, however, it is most common for a line game to be followed directly by a two-line game and a full house game, or just by a full house game with the same balls and cards for multiple games.

As previously described, various types of bingo games may use different types of progressive prizes. The first involves increasing a prize amount based on contributing a portion (either fixed amount or percentage) of each ticket sold to the progressive prize pool. Some progressive prize pools are increased per unit of time, such as a day, week, etc. Progressive prize pools may be grouped in different ways, including by winning pattern, days of the week, bingo session (time of day), etc. Some progressive prize games may change the contribution amount after the game starts and/or stop contributions once the prize reaches a certain value.

Another type of progressive game used in bingo and related games increases the number of called balls to achieve the winning criterion for a given prize. For example, a bingo game with 75 numbers may offer a prize of $10,000 for a coverall achieved with 47 or fewer numbers called. If there are no winners the first week, the same prize may be offered in a new game for a coverall achieved with 48 or fewer calls the next week. The number of calls may be increased each week up to a maximum limit that is less than or equal to the number of possible selections and kept at the selected maximum number of calls until the prize is won. Other winning criterion may include matching objects on the player card to form a designated pattern, such as a line, cluster, postage stamp, diagonal, four corners, or similar patterns.

In virtually all keno, lottery, bingo, and slot machines the progressive portion of the prize is split when there are multiple winners. The progressive portion is the current amount of the progressive meter less the amount of the base jackpot. The progressive portion grows by allocating a percentage of every wager to the progressive meter. Thus, when there are multiple winners, the progressive amount is generally split evenly among all winners. For example, a game starts with a base jackpot of $100,000. As players make wagers, a portion of each wager is added to the progressive meter causing it to grow to $140,000. If two people were to win the progressive jackpot during the same game, they would each be paid the base amount of $100,000 in addition to half of the progressive amount of $40,000 for a total prize award of $120,000. Additionally, in many instances the progressive prize is paid on an aggregate basis and would be split evenly among the winners for $70,000 each in this example.

The various styles of bingo and related games generally have some common features. For example, a particular game (i.e. winning criterion) ends when the first winner satisfies the winning criterion. In combined games, play may continue after a first winner, but the winning criterion and/or prize are changed for a second or subsequent winner, i.e. a single line followed by double line, or a double line followed by a coverall. Similarly, because many jurisdictions require bingo and related games to be played to conclusion (in contrast to keno or lotto type games where it is acceptable to not have a winner), if there is no winner matching the winning criterion within the required number of calls, the winning criterion and/or prize may be changed in a consolation game that is played until a winner is determined, for example. Another common feature of the various games, including keno, lotto, and progressive style games, is that multiple winners generally split or share the prize.

BRIEF SUMMARY

Systems and methods for playing a game of chance, which may either be played as a standalone game of chance or as secondary game for players who pay a premium or who are being allowed to play on a promotional basis, having a winning criterion associated with matching indicia such as objects, graphics, symbols, numbers, letters, or the like on a player card to indicia determined or selected by operator calls or an equivalent selection of game or house indicia identified by the gaming establishment, which may be generated manually by hand, ball cage, ball blower, playing cards, roulette wheel, etc., or electronically by a random number generator or the like, whether individually selected or selected as a group during play and/or pre-selected prior to play.

In one embodiment, a method provides a bingo game in which a pattern of player indicia on a player card is matched to house indicia selected during the game. The method includes providing a plurality of player cards, wherein each player card includes a plurality of player indicia and a pattern that includes at least a portion of the player indicia. The method further includes using a device to randomly select a plurality of house indicia and determining whether a triggering criterion is met during the bingo game. The method also includes awarding a prize for a first player card that achieves a partial pattern match with the selected house indicia upon the determination that the triggering criterion has been met. The partial pattern match is achieved by matching the selected house indicia with a predetermined number of player indicia, but not all of the player indicia, within the pattern.

In another embodiment, a method provides a bingo game in which a pattern of player indicia on a player card is matched to house indicia selected during the game. The method includes providing a plurality of player cards, wherein each player card includes a plurality of player indicia and a pattern that includes at least a portion of the player indicia. The method further includes using a device to randomly select a plurality of house indicia, and awarding a first prize for every player card that achieves a complete pattern match after a number of house indicia is selected that is less than or equal to a first number of house indicia. The complete pattern match is achieved by matching each player indicia within the pattern with the selected house indicia. The method also includes awarding at least one second prize to every player that achieves the complete pattern match after each house indicia is selected up to and including a second number of house indicia, determining whether a triggering criterion is met during the bingo game, and awarding at least one third prize for each player card that achieves a partial pattern match with the selected house indicia upon the determination that the triggering criterion has been met. The partial pattern match is achieved by matching the selected house indicia with a predetermined number of player indicia, but not all of the player indicia, within the pattern.

In yet another embodiment, a system for providing a game of chance includes a display for displaying a first player card of a plurality of player cards. Each player card includes a plurality of player indicia and a pattern including at least a portion of the player indicia. The system also includes a device for randomly selecting a plurality of house indicia and a processor programmed to determine whether a triggering criterion is met during the game of chance and award a prize for the first player card achieving a partial pattern match with the selected house indicia upon the determination that the triggering criterion has been met. The partial pattern match is achieved by matching the selected house indicia with a predetermined number of player indicia, but not all of the player indicia, within the pattern.

In a still further embodiment, a system for providing a game of chance includes a display for displaying at least one player card of a plurality of player cards. Each player card includes a plurality of player indicia and at least one pattern that includes at least a portion of the player indicia. The system also includes a device for randomly selecting a plurality of house indicia and a processor programmed to award a first prize for every player card that achieves a complete pattern match after a number of house indicia is selected that is less than or equal to a first number of house indicia. The complete pattern match is achieved by matching each player indicia within the pattern with the selected house indicia. The processor is also programmed to award at least one second prize to every player that achieves the complete pattern match after each house indicia is selected up to and including a second number of house indicia, determine whether a triggering criterion is met during the game of chance, and award at least one third prize for each player card that achieves a partial pattern match with the selected house indicia upon the determination that the triggering criterion has been met. The partial pattern match is achieved by matching the selected house indicia with a predetermined number of player indicia, but not all of the player indicia, within the pattern.

Systems and methods for gaming according to embodiments of the present disclosure have a number of associated advantages. For example, the Multi-Win and other embodiments according to the present disclosure provide players more excitement and encourage players to cheer for one another rather than cursing when the first winner takes the prize and ends the game. The game may continue after the first winner matches a pattern until all prescribed calls, and associated winning chances, have been made. Various embodiments according to the present disclosure provide more winners, which may be paid by a third-party, with associated fewer consolation prizes paid by the gaming establishment operator. Similarly, embodiments according to the present disclosure offer multiple chances to win no-split prizes, which facilitates reduction in consolation prize expenses. In addition, various embodiments allow operators to generate more profit and restructure prize exposure in favor of a fixed cost per ticket making it possible to generate gross profit even with as little as one ticket sold. Players may also win prizes more frequently and experience more excitement as a result of being able to win prizes for partially matching a pattern in addition to, or instead of winning prizes for matching the complete pattern.

Gaming strategies according to the present disclosure may be applied to virtually any existing or future variations of bingo and similar games of chance. Various embodiments may be used with any winning pattern, combination, or number selections and the like. Cards or tickets may comprise paper, card stock, fixed, portable, or handheld electronic displays, and the like. Embodiments according to the present disclosure may be applied to fixed odds payouts, pari-mutuel, progressive, or any combination thereof. Similarly, embodiments may also be played with any approved method of determining, selecting, or calling house or game indicia such as numbers, words, or other elements to be matched including but not limited to pre-called games, random number generators, ball blowers, card draws, roulette style draws, and the like.

Various embodiments according to the present disclosure may be played with at least two players each playing one or more card faces. Multi-player implementations may be required in some jurisdictions. For example, Class II gaming generally requires the game to be played with at least two players. In addition, various embodiments of the present disclosure may include one or more players playing one or more cards against the house, which may play one or more selected cards. The embodiments of the present disclosure may also be used in various computer or machine based implementations.

The above advantages and other advantages and features will be readily apparent from the following detailed description of the preferred embodiments when taken in connection with the accompanying drawings.

BRIEF DESCRIPTION OF THE DRAWINGS

Embodiments of the present disclosure described herein are recited with particularity in the appended claims. However, other features will become more apparent, and the embodiments may be best understood by referring to the following detailed description in conjunction with the accompanying drawings, in which:

DETAILED DESCRIPTION

Figure 1:
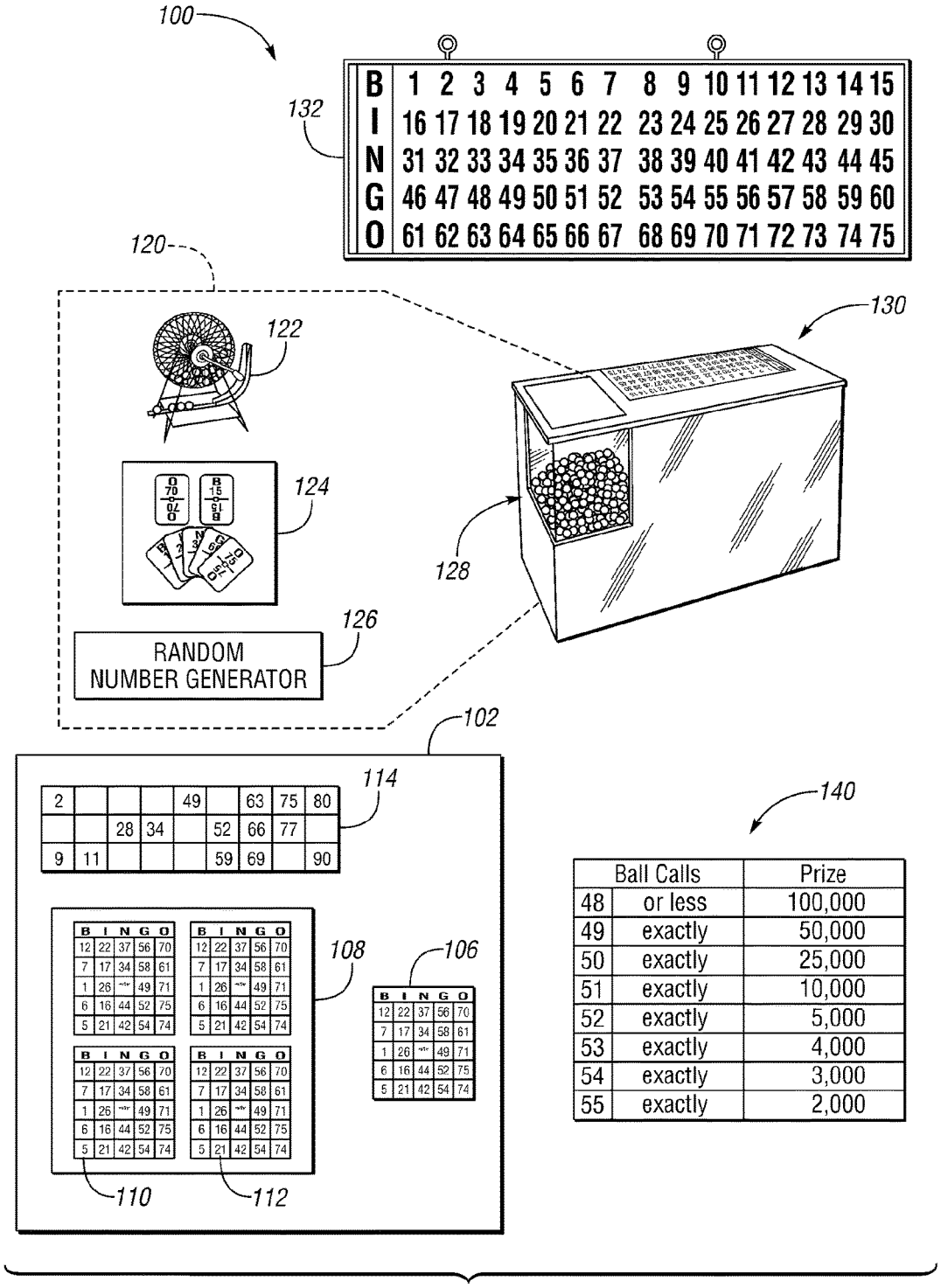
FIG. 1 is a block diagram illustrating operation of a system or method for playing a game of chance according to various embodiments of the present disclosure.

As those of ordinary skill in the art will understand, various features of the embodiments illustrated and described with reference to any one of the Figures may be combined with features illustrated in one or more other Figures to produce embodiments that may not be explicitly illustrated or described in detail. The combinations of features illustrated provide representative embodiments for typical gaming applications for bingo and related games. However, various combinations and modifications of the features consistent with the teachings of the present disclosure may be desired for particular applications or implementations. The representative embodiments used in the illustrations relate generally to a game of chance, such as bingo or a related game, with multiple prizes and/or winners. Those of ordinary skill in the art may recognize similar games or other applications or implementations not specifically described, but that are within the scope of the claims.

The descriptions of various styles of bingo and related gaming are purely illustrative. The systems and methods for gaming according to various embodiments of the present disclosure are generally independent of the size of the pool of indicia and are not limited to the 75 or 90 indicia, elements, balls, or numbers used in various representative embodiments. In addition, those of ordinary skill in the art will recognize that any reference to balls or ball calls apply equally to games where other indicia such as letters, words, names, symbols, constellations, figures, patterns, and the like may be used in place of, or in combination with numbers.

In general, the various embodiments of the present disclosure are independent of the particular manner or strategy for selecting, determining, sequencing, calling, etc. of the house or game indicia. As such, the winning combination, matched selection, number of matches, or pattern of matches for any game may generally be obtained by any predetermined or random selection of indicia using manual, electrical, mechanical, electronic, or computer controlled or assisted devices to match less than or equal to the total number of possible selections. Likewise, operator calls, house or game indicia may be determined, selected, or sequenced individually one at a time, and/or in groups or sets and subsequently displayed or otherwise provided to game players. Whether selected individually or as a group or set, house or game indicia may be displayed or presented individually and/or as a group. For example, a group of game or house indicia may be pre-selected prior to the beginning of a game and displayed or presented as a group to the players. Subsequent selection and presentation may occur for individual calls in substantially real time during game play. As another example, all of the available pool of indicia may be pre-selected or sequenced prior to game play and then called or presented individually to the game players to determine prize awards as described herein.

Those of ordinary skill in the art will recognize that the Multi-Win strategies and other embodiments described in the present disclosure may be applied to virtually any existing or future variation of bingo and related games. The Multi-Win strategies and other embodiments may be used with any winning pattern, combination, number selections, and the like. Similarly, various embodiments of the present disclosure may be played on paper, card stock, or electronically via a video screen on a kiosk or handheld device, for example. Multi-Win strategies and other embodiments according to the present disclosure may be applied to games based on fixed odds payouts, pari-mutuel, progressive jackpots, or any combination thereof. Similarly, although various embodiments may refer to a ball call, an operator call or more generally selection or determination of house or game indicia, the Multi-Win strategies and other embodiments illustrated may be used in games that incorporate various methods for selecting or determining house or game indicia, which may include a number, letter, word, graphic, picture, etc., including but not limited to pre-called games, random number generators, ball blowers, card draws, roulette style draws, and the like. Depending on the particular application and implementation, an operator call or selection or determination of house or game indicia may be performed individually and/or in sets or groups of indicia during game play and/or prior to game play.

A technical effect of the systems, devices, and methods described herein includes at least one of (a) providing at least one player card including a plurality of player indicia and at least one pattern that includes at least a portion of the player indicia; (b) using a device to randomly select a plurality of house indicia; (c) determining whether a triggering criterion is met during the bingo game; and (d) awarding a prize for each player card that achieves a partial pattern match with the selected house indicia upon the determination that the triggering criterion has been met, wherein the partial pattern match is achieved by matching the selected house indicia with a predetermined number of player indicia, but not all of the player indicia, within the pattern.

Another technical effect of the systems, devices, and methods described herein includes at least one of (a) providing at least one player card including a plurality of player indicia and at least one pattern that includes at least a portion of the player indicia; (b) using a device to randomly select a plurality of house indicia; (c) awarding a first prize for every player card that achieves a complete pattern match after a number of house indicia is selected that is less than or equal to a first number of house indicia, wherein the complete pattern match is achieved by matching each player indicia within the pattern with the selected house indicia; (d) awarding at least one second prize to every player that achieves the complete pattern match after each house indicia is selected up to and including a second number of house indicia; (e) determining whether a triggering criterion is met during the bingo game; and (f) awarding at least one third prize for each player card that achieves a partial pattern match with the selected house indicia upon the determination that the triggering criterion has been met, wherein the partial pattern match is achieved by matching the selected house indicia with a predetermined number of player indicia, but not all of the player indicia, within the pattern.

FIG. 1 is a block diagram illustrating operation of a system or method for playing a game of chance having a Multi-Win feature according to various embodiments of the present disclosure. System 100 includes a plurality of player cards 102. The actual type, arrangement, and content of player cards 102 may vary by the game being played. Cards 102 include two different types of cards that have various common features, such as player indicia or objects (numbers in this example) arranged in a grid, table, or array having a plurality of rows and columns. Of course, other arrangements of numbers or other objects are possible that are not in a two-dimensional array. Cards 102 generally include a first plurality of objects, 24 numbers in this example, selected from a pool of a second plurality of objects, such as 75 numbers, for example. The objects may be prearranged in a particular order or pattern, typically randomly. In some games, game players may optionally pick some of the numbers and/or arrange the numbers on the card as described in greater detail herein. In the embodiment illustrated, player card 106 includes a single card face having 24 numbers and a free space arranged in rows and columns with each column labeled with a letter, B,I,N,G,O, in this example. Card 108 includes multiple card faces 110, 112 that may be played for a single game, or may be used for multiple games or combination games depending on the particular implementation.

As also illustrated in FIG. 1, various embodiments having a Multi-Win feature according to the present disclosure may be played with a player card or ticket 114 such as commonly used in Europe, for example. Ticket 114 includes three rows and nine columns with five numbers or objects and four spaces in each row and at least one number or object in each column. Although multi-face cards 108 and single cards 106 may be used in a single game, most games would not include different types of cards, such as cards 114 and 106, for example. However, the Multi-Win feature of various games according to the present disclosure does not preclude the use of more than one type of card in any particular game.

System 100 includes at least one device as generally represented by reference numeral 120 for randomly selecting called objects from a pool of objects. For example, device 120 may be implemented by one or more of a ball cage 122, a deck of cards 124, an electronic or computer controlled random number generator 126, or a ball blower 128, although typically only one device is used in any particular game. The present disclosure is independent of the particular type of device 120 or method used to select, sequence, or otherwise determine called numbers or objects (also referred to as "house indicia") as previously described. A master table, chart, or board 130 may be used to keep track of called numbers in combination with a display 132 viewable by game players. In the embodiment of FIG. 1, display 132 is implemented by a bingo flashboard that displays each called number. Display 132 may have the numbers or objects arranged in rows and columns as shown, or in any other convenient format. In one embodiment, the winning criterion for a prize is determined based on at least in part on a pattern of numbers as arranged on flashboard 132. The winning criterion or criteria may also include a predetermined number of matching numbers and/or a pattern of matching numbers on a player card 102 as described in greater detail herein.

System 100 includes an associated prize schedule or pay table 140 that governs awarding of prizes and prize amounts for satisfying various winning criterion. As illustrated in FIG. 1, pay table 140 awards a first prize of $100,000 for every player card 102 that satisfies a first winning criterion, which is a coverall in this example, up to and including a first number of calls. As such, any card 102 that matches all 24 numbers in 48 calls or less is awarded the first prize of $100,000. In this embodiment, pay table 140 also includes prize amounts for awarding one or more subsequent prizes for every player card 102 that satisfies the first winning criterion (coverall or matching 24 numbers) after the first number of calls up to and including a second number of calls, which is 55 in this example. Other embodiments may include only a single intermediate call number with an associated prize, or a group or set of predetermined call numbers between 48 and 55 calls that have associated prize amounts. For example, a prize may only be awarded for satisfying the winning criterion at 48 calls or less, 50 calls, and 55 calls. The prize amounts may be paid on a no-split basis, divided among multiple simultaneous winners, or some combination thereof, depending on the particular implementation. System 100 may also include a consolation prize (not specifically illustrated in this embodiment) awarded for a player card 102 that satisfies the first winning criterion after the second number of calls, i.e. play may continue until at least one player matches all 24 numbers or objects on a card. Alternatively, a pay table 140 having prizes associated with each possible number of matches for all player cards may be used as described in greater detail below. The game only ends once all calls up to and including the second number of calls have been made and cannot end simply because a player or players have achieved the prescribed winning criterion pattern or number beforehand.

System 100 may be used in various types of games with associated pay tables 140 as described herein. In one embodiment, with a modified pay table from that illustrated, a game offers a prize of $10,000 to players that achieve a coverall in 50 or fewer ball calls. In contrast to a traditional game where the game ends when a player wins on the 47th call, for example, the Multi-Win bingo game according to the present disclosure would not be over and the other players would still have a chance to win the $10,000 top prize through the 50th call. In a Multi-Win game of bingo or similar game according to the present disclosure, after the player is paid for winning on the 47th call, the 48th number is drawn and any winners would be awarded the top prize of $10,000. Then the 49th and 50th numbers are drawn and called and any winners are paid $10,000. Additionally, in this embodiment, all winners are paid the full amount even if there are multiple winners at a given ball call. For example, if three people achieve the winning pattern when the 49th number is drawn, they are each paid the full prize amount of $10,000.

Various embodiments according to the present disclosure include no-split progressive prizes or jackpots that may be in addition to the prizes awarded according to the associated prize schedule or pay table. For any game, the odds of multiple winners may be computed as described herein. Once these probabilities have been determined, the percentage or amount of each wager contributed to the progressive meter is determined. Having factored in the additional cost of multiple winners, the operator may offer to pay progressive jackpots in full to all winners on a no-split basis. Depending on the particular implementation, a third-party or entity separate from the operator may assume financial responsibility for paying prizes awarded according to the pay table or prize schedule, with the operator responsible for consolation prizes, if any. Of course, the third-party or other entity obtains a fee associated with the game that may be a commission, percentage or similar fee, for example.

Alternatively, or in combination, tiered prizes or awards may be provided. Instead of offering only a single prize amount up to prescribed number of ball calls, several prizes may be offered together and tiered according to the ball call after the prescribed number of ball calls for the top prize. The following table represents a prize schedule for the representative embodiment illustrated in FIG. 1 with tiered prizes or awards according to the present disclosure:

| Calls | | Prize |
|---|---|---|
| 48 | or less | 100,000 |
| 49 | exactly | 50,000 |
| 50 | exactly | 25,000 |
| 51 | exactly | 10,000 |
| 52 | exactly | 5,000 |
| 53 | exactly | 4,000 |
| 54 | exactly | 3,000 |
| 55 | exactly | 2,000 |

In this embodiment, the game ends after a second number of operator calls, e.g., a fixed number of calls, such as 55 in this example, if one or more player cards satisfied the winning criterion. Including a Multi-Win feature according to embodiments of the present disclosure awards the first prize of $100,000 to every player that satisfies the winning criterion in less than or equal to 48 calls, and the game continues through the 55th call and awards subsequent prizes for each card satisfying the same winning criterion. For example, a winner satisfying the winning criterion (coverall in this example) after 46 calls is awarded the first prize and play continues with the same winning criterion. A winner after 47 calls or 48 calls is also awarded the first prize of $100,000. Play continues with the 49th call and any player cards meeting the winning criterion (coverall) are paid $50,000. Play continues through the end of the prize board or pay table, which includes 55 calls in this example. The game does not end prior to all calls up to and including the second number of calls have been completed. However, if none of the player cards satisfies the winning criterion after 55 calls, the game may use one or more means or devices to conclude the game in different ways depending on the particular implementation. In one embodiment, play continues until the first call where at least one player card satisfies the first winning criterion. In another embodiment, the Multi-Win game is combined with a consolation game having a second winning criterion to determine a consolation or standard prize winner. For example, the first criterion may be a single line, and the second criterion a coverall. Alternatively, or in combination, rather than continuing calls for a consolation prize, which requires a varying number of calls to establish a winner, the game may use a device such as a strategy, rule, pay table, computer, machine, etc. that ends or concludes the game at any fixed number of calls with a corresponding prize schedule that accounts for all remaining possible outcomes. In this example with player cards each having 24 numbers and a total pool of 75 numbers, the game could be concluded after 55 calls by combining the above pay table with a pay table having an associated prize for matching between 0 and 23 numbers as described in greater detail herein.

In another embodiment, alternatively, or in combination, tiered prizes or awards may be provided. Instead of offering only a single prize amount up to a prescribed number of ball calls, several prizes may be offered together and tiered according to the ball call after the prescribed number of ball calls for the top prize.

Various embodiments may include pay tables that do not have a prize associated with every call between the first number of calls associated with the first prize and the second number of calls associated with the last non-consolation prize. The following pay tables represent a prize schedule for a representative embodiment as illustrated in FIG. 1 with tiered prizes or awards wherein the prescribed ball call winning numbers are comprised of one or more numbers of calls between the first number of calls for the first prize and the second number of calls for the last non-consolation prize where at least some calls do not have corresponding prizes. In the first example, the following pay table provides a first prize for matching a first winning criterion with 48 calls or less of $100,000, with subsequent even numbers of calls at 50, 52, etc. having associated tiered prize awards. Similarly, the second example provides a pay table awarding a first prize of $100,000 for cards satisfying the first winning criterion in 47 calls or less, with subsequent odd numbers of calls at 49, 51, etc. having corresponding tiered prize awards according to the present disclosure:

| Calls | | Prize |
|---|---|---|
| 48 | or less | 100,000 |
| 50 | exactly | 35,000 |
| 52 | exactly | 5,000 |
| 54 | exactly | 3,000 |
| 56 | exactly | 1,000 |
| 47 | or less | 100,000 |

-continued

| Calls | | Prize |
|---|---|---|
| 49 | exactly | 35,000 |
| 51 | exactly | 5,000 |
| 53 | exactly | 3,000 |
| 55 | exactly | 1,000 |

In this embodiment, the game ends after a second fixed number of operator calls, each of which may be generated manually by hand, ball cage, ball blower, playing cards, roulette wheel, etc., pre-called, or electronically by a random number generator or the like, such as 56 operator calls in the first example, if one or more player cards satisfied the winning criterion. Including a plurality Multi-Win feature according to various embodiments of the present disclosure awards the first prize of $100,000 to every player that satisfies the winning criterion in less than or equal to 48 calls, and the game continues through the 56th call and awards subsequent prizes for each card satisfying the same winning criterion with a corresponding prize award from the pay table. For example, a winner satisfying the winning criterion (coverall in this example) after 47 calls is awarded the first prize and play continues with the same winning criterion. A winner after 48 calls is also awarded the first prize of $100,000. Play continues through the end of the prize board or pay table, which includes 56 calls in the first example. However, if none of the player cards satisfies the winning criterion after 56 calls, the game may be concluded in different ways depending on the particular implementation. In one embodiment, play continues until the first call where at least one player card satisfies the winning criterion. In another embodiment, a second winning criterion is used to determine a consolation or standard prize winner. For example, the first criterion may be a single line, and the second criterion a coverall. Alternatively, or in combination, rather than continuing calls for a consolation prize, which requires a varying number of calls to establish a winner, the game may be concluded at any fixed number of calls with a corresponding prize schedule that accounts for all remaining possible outcomes. In the first example with player cards each having 24 numbers and a total pool of 75 numbers, the game could be concluded after 56 calls by combining the above pay table with a pay table having an associated prize for matching between 0 and 23 numbers as described in greater detail herein. The odd embodiment operates in a similar manner.

As previously described, one of the advantages of the Multi-Win strategy of the present disclosure is the ability to apply it to a number of variations to maintain player interest and excitement. In a pure no-split variation, all players who meet the winning criterion are each paid the associated prize without splitting or sharing the prize if multiple winners meet the criterion after any particular call. For example, in a game where the winning criterion requires a particular pattern, such as a coverall, in 48 calls or less, every player satisfying the criterion within 48 calls would each be paid or awarded the same prize of $100,000, for example, without any splits. As such, if there is one winner at 46 calls, the winner is paid $100,000. If the 47th call results in two additional winners, each winner is paid $100,000, and so on through the 48th number called. The game continues and all winners are paid or awarded associated prizes through the 55th ball call. If there are no winners, the game continues for the consolation prize, or is concluded with a pay table accounting for all remaining possible outcomes. The game may only end once all calls up to and including the second number of calls have been made and a player or players have achieved the prescribed winning criterion pattern or number.

Another advantage of the Multi-Win system and method is to allow for play either as a primary game or secondary simultaneous game, formatted relative to the primary game, available to players who pay an additional fee and/or awarded to players on a promotional basis wherein only those select players are allowed to participate in possible longer game play while for the other players, the game has ended. This may generate additional revenue for the operator or maintain a level of loyalty of customers. Many gaming operators have player's clubs which distribute player cards which award points dependent upon the amount wagered and/or amount of time played. Commonly, an operator may create differing levels of player cards such as a silver card, a gold card, and a platinum card. Accordingly, by example, an operator may require a player without a player card or a player with only a silver card status to pay a premium to play a secondary simultaneous game while awarding free play to players with a gold or platinum card.

In another embodiment, the grand prize is only awarded to the first winner or winners. In this variation, the grand prize is split or shared in the event of multiple winners associated with a particular call. Once the grand prize has been awarded, the game continues for the next prize level, such as $50,000 in this representative embodiment. For example, if a player card satisfies the winning criterion at 46 calls, that player card is awarded a prize of $100,000 (multiple winners would split the prize equally). The game would continue and any players that achieve winning combinations at operator calls 47, 48, or 49 would each be paid the next prize level of $50,000. This embodiment limits the prize exposure for the operator. The operator call and associated prizes continue through the predetermined number of calls, i.e. through the 55th ball call in this example. If there are no winners after the 55th call, the game continues for the consolation prize. In another variation of this embodiment, the grand prize is paid in full on a no split basis to the first winner or winners. Then players play for the next or second prize level until the first number of calls is completed. Subsequent calls may each have an associated prize award until a predetermined number of calls is completed. If there are no winners after the predetermined number of calls, play continues for a consolation prize until a winner is determined, or for a fixed number of calls with a pay table accounting for all remaining possible outcomes.

As previously described, any of the embodiments may be combined to create multiple combinations and may be played as the primary game of chance or as a secondary game of chance for players who pay an additional fee or are awarded to players on a promotional basis with the game continuing until at least all calls, and associated winning chances, up to and including the second number of calls have been made. For example, the following table provides representative combinations of a grand prize and secondary prize. Any of the grand prize strategies in the grand prize column may be combined with any of the secondary prize strategies in the secondary prize column to determine the awards for a particular game as follows:

| Grand Prize | Secondary Prize |
|---|---|
| Grand prize is paid in full to all winners at or below a given ball call | Secondary prize is paid in full to all winners at or below a given ball call |

-continued

| Grand Prize | Secondary Prize |
|---|---|
| Grand prize is paid on a no split basis to the first winner or winners | Secondary prize is paid on a no split basis to the first winner or winners |
| Grand prize is paid on an aggregate basis and can only be paid once during any given game, multiple winners would split the prize | Secondary prize is paid on an aggregate basis and can only be paid once during any given game, multiple winners would split the prize |

These variations may be successively applied to other prize levels, individually or collectively, creating numerous possible combinations. In addition, any of these variations can be structured to include one or several progressive prize elements.

Although bingo games and related games of chance generally have winning criterion based on forming a pattern on a player card, some games offer a prize for correctly matching a predetermined number of the called numbers on a playing card after a particular number of calls. For example, a grand prize may be awarded for matching 8 numbers on a card after 20 calls. The Multi-Win version of this game according to one embodiment of the present disclosure offers different prize levels on a no-split basis depending on the number of matches after the predetermined number of calls. The following is a pay table or prize schedule for a representative embodiment:

| Match | Prize |
|---|---|
| 8 | 25,000 |
| 7 | 500 |
| 6 | 50 |
| 5 | 5 |

The above prize schedule is based on a representative embodiment with a pool of 75 numbers or objects of which 20 are selected. Of course, one of ordinary skill in the art will recognize that a series of pay tables may be constructed for different numbers of calls and associated prizes offered individually or collectively. For example, in one embodiment, prize structures are established for 8 through 75 calls. Once a player correctly matches all 8 selected numbers, the rest of the players win the corresponding prize for that call. The same type of game structure may be established for any set of initial number selections, whether they are selected by the player, randomly generated, or any combination thereof less than or equal to the number of selections that are possible.

The Multi-Win Pick embodiment may also be designed to have different triggering events or criteria other than having X matches after a predetermined number of calls. For example, the triggering event or criterion may be associated with: a pattern on the master flash board, a pattern on any electronic card, a pattern on any paper card, a pattern on any card in play, a pattern on a randomly selected card, etc. These triggering events or patterns may or may not have anything to do with the underlying process of matching X selections to a draw of Y numbers.

As previously described, the consolation prize element of various types of bingo and related games may be a significant operating expense. Although bingo regulations vary considerably by jurisdiction, they generally include a requirement that the game must be played to conclusion, i.e. there must be at least one winner. Multi-Win strategies according to various embodiments of the present disclosure may be used to reduce or eliminate consolation prizes by offering tiered prizes that include payouts for all possible outcomes.

One embodiment of a pay table according to the present disclosure that may be used to provide a payout for all possible outcomes for a Pick 8 game is provided below:

| Match | Prize |
|---|---|
| 8 | 25,000.00 |
| 7 | 25.00 |
| 6 | 5.00 |
| 5 | 3.00 |
| 4 | 2.00 |
| 3 | 1.00 |
| 2 | 0.25 |
| 1 | 0.10 |
| 0 | 0.05 |

This concept may be applied to any bingo or related game that utilizes the underlying process of matching X selections (shown in the Match column of the prize table) to a draw of Y numbers (20 in this example). Similarly, a pay table or prize schedule having payouts for all possible outcomes may be applied to various other types of bingo and related games as previously described.

A prize schedule or pay table for a bingo coverall game having a maximum number of calls according to one embodiment of the present disclosure is shown below. The prize schedule accounts for all possible outcomes after the scheduled maximum number of calls have been completed. In this example using cards having 24 numbers, words, or other objects, the prize schedule includes a non-zero prize award for all possible number of matches from zero through 24. Depending on the number of calls, the prize schedule may account for only the remaining possible outcomes depending on how the numbers are assigned to the cards.

| Match | Prize |
|---|---|
| 24 | 100,000.00 |
| 23 | 5,000.00 |
| 22 | 4,000.00 |
| 21 | 3,000.00 |
| 20 | 2,000.00 |
| 19 | 1,000.00 |
| 18 | 500.00 |
| 17 | 50.00 |
| 16 | 20.00 |
| 15 | 10.00 |
| 14 | 5.00 |
| 13 | 0.50 |
| 12 | 0.25 |
| 11 | 0.05 |
| 10 | 0.05 |
| 9 | 0.05 |
| 8 | 0.05 |
| 7 | 0.05 |
| 6 | 0.05 |
| 5 | 0.05 |
| 4 | 0.25 |
| 3 | 0.50 |
| 2 | 3,000.00 |
| 1 | 5,000.00 |
| 0 | 10,000.00 |

If none of the cards satisfy the winning criterion (a coverall, for example) within the maximum scheduled number of calls (47, for example), players are paid or awarded a prize based on the total number of matches to the called indicia on each card or ticket for that game. For pattern games, such as a Letter X, in which the winning pattern corresponds to matching indicia arranged along both diagonals of the grid or array, the prize may be determined based on only the matching indicia making up the winning pattern, or alternatively based on all the matching indicia on the winning card or face. This strategy may be applied to any type of bingo or related game.

In another embodiment, the pay table or prize schedule includes prizes for some, but not all possible outcomes. This would reduce, but not eliminate the necessity of a consolation prize award to meet the requirement that the game is played to conclusion. Games structured in this fashion also have the added operator incentive of a fixed or maximum number of calls. Embodiments having a fixed or maximum draw or number of calls provide operators greater certainty in scheduling games as the time required to complete each game does not vary based on the number of calls required to determine a winner.

As those of ordinary skill in the art will appreciate, any game structured with payouts for all possible combinations effectively allows the operator (sometimes referred to as "the house") to offer a pari-mutuel game without having any progressive meters or allocations.

Various embodiments according to the present disclosure provide multiple potential payouts by awarding prizes to players that have substantially satisfied the winning criterion, i.e. almost achieved a winning pattern or combination. The following is a pay table that may be used in a representative embodiment of a European style game with 38 calls or less:

| Match | Prize |
|---|---|
| 15 | 100,000.00 |
| 14 | 2,000.00 |
| 13 | 1,000.00 |
| 12 | 100.00 |
| 11 | 10.00 |

Other embodiments according to the present disclosure provide a matrix of possible prizes. The following table is a representative prize matrix for a bingo coverall with columns corresponding to calls 47-50 and rows corresponding to matches 24-20:

| | Call | | | |
|---|---|---|---|---|
| Match | 47 | 48 | 49 | 50 |
| 24 | 50,000 | 10,000 | 5,000 | 3,000 |
| 23 | 5,000 | 2,500 | 2,000 | 2,500 |
| 22 | 3,000 | 2,000 | 1,000 | 1,500 |
| 21 | 2,000 | 1,000 | 750 | 1,000 |
| 20 | 1,000 | 500 | 500 | 500 |

These prizes may be offered collectively or individually, by row, column, or entire matrix, etc. Additionally, if the entire matrix is not offered, the triggering event that determines the prize levels can be a top prize winner, a winner at another level, achieving a particular pattern on the card, etc. depending on the particular implementation. Similarly, the matrix may include one or more zero entries where no prize is awarded for a particular call/match combination.

Figure 2:
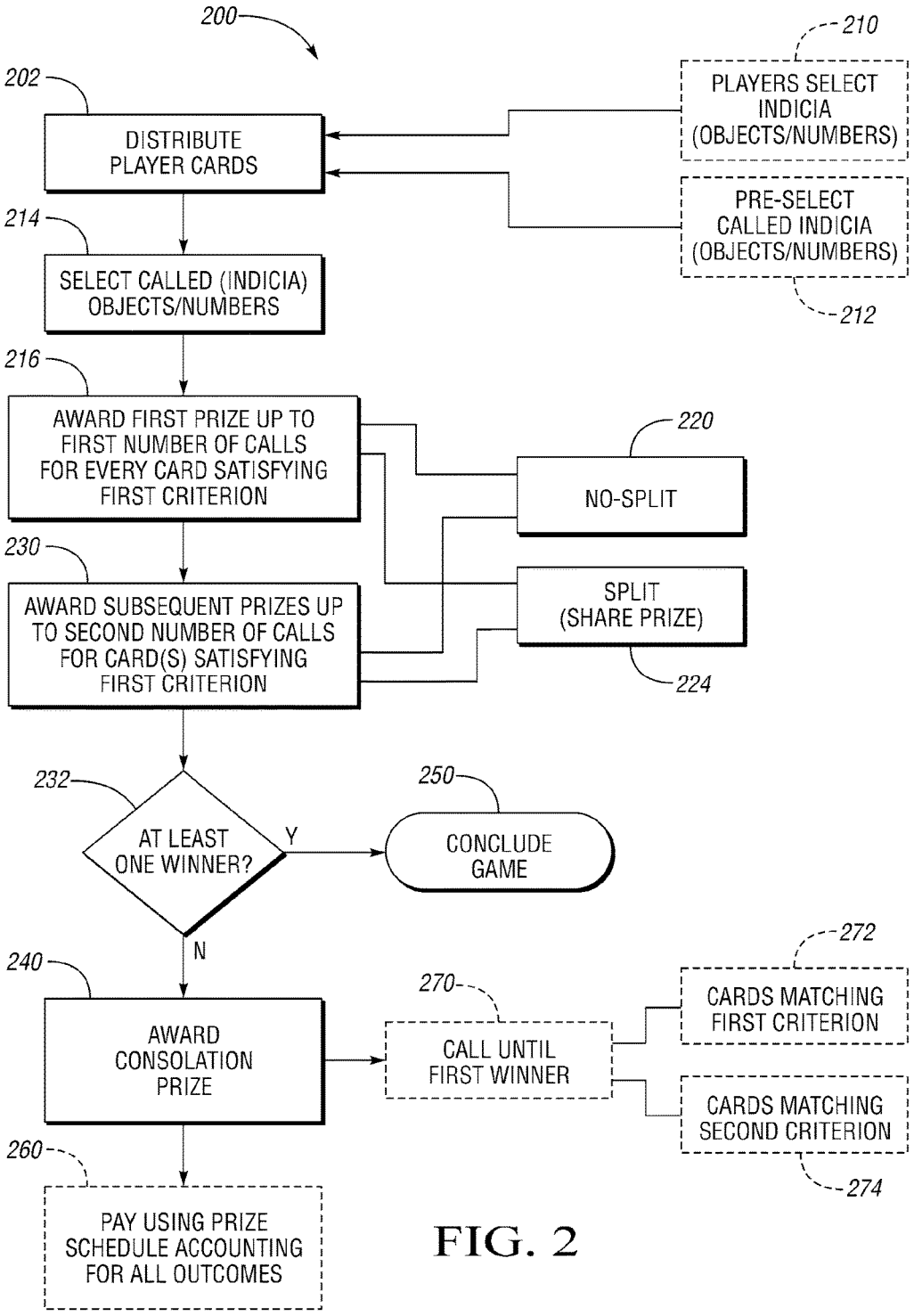
FIG. 2 is an alternative representation illustrating a system or method for playing a game of chance such as bingo or a related game having multiple prizes and/or winners according to embodiments of the present disclosure.

FIG. 2 is an alternative representation illustrating a system or method for playing a game of chance such as bingo or a related game having multiple prizes and/or winners according to embodiments of the present disclosure. System or method 200 may include distributing a plurality of player cards each having a first plurality of indicia such as numbers selected from a pool having a second plurality of indicia as generally represented by block 202. The first plurality of indicia (numbers, symbols, graphics, words, or other objects, etc.) may be prearranged on each card. In one embodiment players may select objects or numbers for each purchased player card and/or arrange selected numbers within a corresponding array or grid subject to various limitations as generally represented by block 210. Similarly, some games may include pre-selecting a predetermined number of called game or house indicia (objects, numbers, etc.) as represented by block 212. The game continues with the operator (implemented by computer in some cases) repeatedly reporting or calling house indicia that may be sequenced, selected, or otherwise randomly generated or determined individually and/or in groups before and/or during game play as generally represented by block 214. After each called number up to and including a first number of calls, a prize is awarded for every card that includes objects satisfying a first winning criterion as represented by block 216. The first prize may be awarded on a no-split basis as represented by block 220 or on a shared or aggregate basis as represented by block 224. The first winning criterion may include matching a predetermined number of objects on the player card with objects determined by the operator calls, for example, or may include matching objects on the player card to form a designated pattern, such as a line, cluster, postage stamp, diagonal, four corners, or similar pattern. Alternatively, the first winning criterion may be the absence of any of a number of predetermined patterns or not matching any numbers, for example.

With continuing reference to FIG. 2, play continues after the first number of operator calls with subsequent or secondary prizes awarded for each card satisfying the first winning criterion up to and including a second number of calls as represented by block 230. Similar to the top prize, one or more of the subsequent or secondary prizes may be awarded on a no-split basis as represented by block 220, or on a shared or aggregate basis as represented by block 224. If at least one card satisfied the first winning criterion as represented by block 232, the game ends after the second number of calls as represented by block 250. If no winner is determined after the second number of calls, one or more consolation or standard prizes are awarded as represented by block 240. Depending on the particular implementation, a consolation prize may be awarded based on a prize schedule that includes a prize amount associated with each possible remaining outcome as represented by block 260 such that the game concludes in a fixed number of calls. Alternatively, or in combination, the game may continue until a consolation winner is determined, or for a third number of calls as represented by block 270. If a fixed third number of calls is specified and no winner is determined, then the consolation prizes are awarded using a pay table as described with reference to block 260. Otherwise, calls continue until at least one player card is determined to be a winner by satisfying the first winning criterion as represented by block 272. Alternatively, one or more consolation prizes may be awarded based on satisfying a second winning criterion as represented by block 274.

As previously described, various embodiments may be implemented as multi-player games, particularly where required by gaming regulations to satisfy a particular type or class of gaming. Alternatively, or in combination, various embodiments may be implemented as games with players playing one or more cards against the house (i.e., the entity that oversees and/or operates the game and/or the gaming establishment). In one embodiment, the house plays one or more selected cards ("house cards"). Depending on the particular implementation, players may play against one another as well as one or more house cards, players may play only against the house card, the house card may be used to determine when the game ends, i.e. when the house card(s) satisfy the winning criterion, and/or the house card may be used to determine a bonus prize, for example. Similarly, games may be played with interim or intermediate prize awards for matching a corresponding interim winning criterion different from the first winning criterion. The number or occurrence of interim prizes awarded would not be considered when determining whether to conclude the game, i.e., the game would end only after at least one player satisfied the first winning criterion. Otherwise, play would continue for the consolation prize, or prizes would be awarded for all remaining possible outcomes as previously described.

Those of ordinary skill in the art will also recognize that the various embodiments of a Multi-Win strategy according to the present disclosure may be used as a bonus or premium prize in combination with a conventional bingo or related game of chance. For example, only designated cards or faces may be playing according to the Multi-Win pay table. Designated cards may be purchased for a fixed or tiered premium relative to standard cards, or may be awarded as part of a frequent player club or other loyalty program, for example.

Most operators and players understand the benefits to offering multiple winners and/or prizes according to various embodiments of the present disclosure. A cursory examination of various embodiments of a Multi-Win game according to the present disclosure may suggest that the prize awards are cost prohibitive. However, the following more careful analysis demonstrates that pay tables constructed according to the present disclosure can be used effectively to provide operators with an attractive profit.

One common way in which the game of bingo is played is to offer a prize for players that achieve a designated pattern or combination in a given number of ball calls or less. As an example, a game might offer a prize of $10,000 to a player that achieves a coverall or blackout (covers all 24 numbers on a bingo card), in 50 ball calls or less. One way to compute the theoretical or expected cost of offering this prize is to compute the probabilities of a coverall occurring between 24 (the minimum number of calls required for a 25 number card with one free space) and 50 calls. This is based on an analysis of the possible winning combinations at each ball call relative to the total number of possible combinations. The number of combinations of choosing K objects from a pool of N objects can be computed as follows:

$$C\left(\frac{N}{K}\right) = \frac{N!}{K!(N-K)!}$$

Where N represents the number of objects in the pool from which to choose and K represents the number of objects chosen.

Once the number of combinations has been determined, the probability of a particular outcome, such as a winner or no winner, may be established by the ratio of that outcome to all possible outcomes. If the cumulative probability of matching 24 numbers on a bingo card after n calls is represented by P(n), then the probability of a coverall in a game with a pool of 75 possible elements or numbers can be computed according to:

$$P_{(24)} = \frac{C\left(\frac{24}{24}\right)\times\left(\frac{51}{0}\right)}{\left(\frac{75}{24}\right)}$$

$$P_{(24)} = \frac{\left(\frac{24!}{24!\times(24-24)!}\right)\left(\frac{(51)!}{51!\times(51-51)!}\right)}{\left(\frac{75!}{24!\times(75-51)!}\right)}$$

Of course, the number of combinations of 24 items selected from a pool of 24 items is 1. However, it is included in the formula above to illustrate a specific example for the generalized formula or equation. Because it is impossible to match 24 numbers in less than 24 calls, the theoretical cost or expected value (T) of offering this prize in 24 calls or less (n=24) is simply: T=P(24) times the prize value. However, in traditional prior art bingo games, the first winner generally ends the game. As such, if someone wins at 24 calls, the game is over. Thus the theoretical or expected cost of offering the same prize for n>24 is as follows:

$$T_{(n>24)}=(P_{(n)}-P_{(n-1)})\times\text{Prize}\times(1-P_{(n-1)})$$

Where $P_{(n)}-P_{(n-1)}$ is the exact probability of a coverall in n balls drawn, and $1-P_{(n-1)}$ is the probability that there was not a winner during any of the prior ball calls.

Because $P_{(n)}$ represents the cumulative probability, $P_{(n)}-P_{(n-1)}$ is computed to provide the exact probability of achieving the pattern in n calls for n>24. Additionally, because in traditional bingo the game would be over if someone were to win after 24 ball calls (n=24), for n>24 the probability that there was not a winner at the prior ball call must also be included, as represented by the $(1-P_{(n-1)})$ term.

The following table provides a comparison of probabilities for a traditional prior art bingo game and a Multi-Win strategy according to various embodiments of the present disclosure:

| Calls | Cumulative Probability $P_{(n)}$ | Exact Probability $P_{(n)} - P_{(n-1)}$ | Traditional Bingo $(P_{(n)} - P_{(n-1)}) \times (1 - P_{(n-1)}) \times$ Prize | Multi-Win Bingo $(P_{(n)} - P_{(n-1)}) \times$ Prize |
|---|---|---|---|---|
| 24 or less | 3.879E−20 | 3.879E−20 | 3.879E−16 | 3.879E−16 |
| 25 exactly | 9.698E−19 | 9.310E−19 | 9.310E−15 | 9.310E−15 |
| 26 exactly | 1.261E−17 | 1.164E−17 | 1.164E−13 | 1.164E−13 |
| 27 exactly | 1.135E−16 | 1.009E−16 | 1.009E−12 | 1.009E−12 |
| 28 exactly | 7.943E−16 | 6.808E−16 | 6.808E−12 | 6.808E−12 |
| 29 exactly | 4.607E−15 | 3.812E−15 | 3.812E−11 | 3.812E−11 |
| 30 exactly | 2.303E−14 | 1.843E−14 | 1.843E−10 | 1.843E−10 |
| 31 exactly | 1.020E−13 | 7.897E−14 | 7.897E−10 | 7.897E−10 |
| 32 exactly | 4.080E−13 | 3.060E−13 | 3.060E−09 | 3.060E−09 |
| 33 exactly | 1.496E−12 | 1.088E−12 | 1.088E−08 | 1.088E−08 |
| 34 exactly | 5.087E−12 | 3.591E−12 | 3.591E−08 | 3.591E−08 |
| 35 exactly | 1.618E−11 | 1.110E−11 | 1.110E−07 | 1.110E−07 |
| 36 exactly | 4.855E−11 | 3.237E−11 | 3.237E−07 | 3.237E−07 |
| 37 exactly | 1.382E−10 | 8.964E−11 | 8.964E−07 | 8.964E−07 |
| 38 exactly | 3.751E−10 | 2.369E−10 | 2.369E−06 | 2.369E−06 |
| 39 exactly | 9.753E−10 | 6.002E−10 | 6.002E−06 | 6.002E−06 |
| 40 exactly | 2.438E−09 | 1.463E−09 | 1.463E−05 | 1.463E−05 |
| 41 exactly | 5.880E−09 | 3.442E−09 | 3.442E−05 | 3.442E−05 |
| 42 exactly | 1.372E−08 | 7.840E−09 | 7.840E−05 | 7.840E−05 |
| 43 exactly | 3.105E−08 | 1.733E−08 | 1.733E−04 | 1.733E−04 |
| 44 exactly | 6.831E−08 | 3.726E−08 | 3.726E−04 | 3.726E−04 |
| 45 exactly | 1.464E−07 | 7.807E−08 | 7.807E−04 | 7.807E−04 |

-continued

| Calls | Cumulative Probability $P_{(n)}$ | Exact Probability $P_{(n)} - P_{(n-1)}$ | Traditional Bingo $(P_{(n)} - P_{(n-1)}) \times (1 - P_{(n-1)}) \times$ Prize | Multi-Win Bingo $(P_{(n)} - P_{(n-1)}) \times$ Prize |
|---|---|---|---|---|
| 46 exactly | 3.061E−07 | 1.597E−07 | 1.597E−03 | 1.597E−03 |
| 47 exactly | 6.255E−07 | 3.194E−07 | 3.194E−03 | 3.194E−03 |
| 48 exactly | 1.251E−06 | 6.255E−07 | 6.255E−03 | 6.255E−03 |
| 49 exactly | 2.452E−06 | 1.201E−06 | 1.201E−02 | 1.201E−02 |
| 50 exactly | 4.715E−06 | 2.263E−06 | 2.263E−02 | 2.263E−02 |
| | Total | | 4.715E−02 | 4.715E−02 |

Applying the analysis above to a representative game offering a grand prize of $10,000 at 50 numbers or less in which the game is stopped (traditional prior art bingo), or a game in which the grand prize is no longer available demonstrates that the Multi-Win strategy according to the present disclosure may be used to advantage to provide acceptable operator profits.

The totals at the bottom of the table represent the sums of the respective columns and represent the expected value or theoretical cost of the prize. These results indicate that offering a prize of $10,000 in 50 calls or less yields a theoretical cost of $0.04715 per card face. Although the totals appear to be identical, there is a minor difference. The expected value or theoretical cost of the Multi-Win method according to the present disclosure is actually 0.0000000757 greater than that of the traditional prior art bingo method of play. Although this result may appear to be erroneous, and is most certainly counterintuitive, it demonstrates the feasibility of providing a Multi-Win gaming strategy according to embodiments of the present disclosure. The implications of these results suggest that rather than ending a game when a first player satisfies the winning criterion (or criteria) or after a predetermined number of calls with no winner, such as 47 for example, an operator can continue the game and pay all winners on a non-split basis through 50 calls, for example, at an associated additional cost of only $7.57E-08.

The computation of the theoretical cost of offering the same prize of $10,000 in 50 calls or less in the Multi Win format is a little different than that of traditional bingo. In the Multi-Win format, all players that achieve a winning pattern, or in this example a coverall, in 50 balls called or less would each be paid the $10,000. As an example, if a player achieves a coverall after 47 balls have been called, he or she would be paid $10,000. The game (same winning criterion) and the ball draws or calls would continue. If two players achieve the winning pattern on the 48th call, each is paid $10,000. This process continues through a predetermined number of calls, such as the 50th call in this example. The comparison of the expected costs for traditional prior art bingo relative to this embodiment of Multi-Win Bingo® according to the present disclosure can be computed as described below.

For n=24, the expected cost for each method of play is exactly identical and is equal to $P_{(24)}$ times the prize amount for each method of play. Below are the formulas for each method of play for n>24.

For traditional bingo:

$$T=(P_{(n)}-P_{(n-1)})*\text{Prize}*(1-P_{(n-1)})$$

For Multi-Win bingo:

$$T=(P_{(n)}-P_{(n-1)})*\text{Prize}$$

One of the ways for computing the cost of the $10,000 prize offered at 50 numbers or less is as follows for traditional bingo:

$$T_{(50)}=P_{(24)}\times\text{Prize}+\Sigma_{n=25}^{n=50}(P_{(n)}-P_{(n-1)})\times\text{Prize}\times(1-P_{(n-1)})$$

And for Multi-Win bingo:

$$T_{(50)}=P_{(24)}\times\text{Prize}+\Sigma_{n=25}^{n=50}(P_{(n)}-P_{(n-1)})\times\text{Prize}$$

A comparison of the above computations illustrates that the only difference between them is the $(1-P_{(n-1)})$ term. This is congruent with the operational differences between the prior art games and Multi-Win games according to the present disclosure. In particular, according to various embodiments of bingo and related games having a Multi-Win feature as disclosed herein, it does not matter if someone has won on the prior ball call. Rather, play continues with each winner receiving a prize according to the prize schedule or pay table.

The following table illustrates the approximate values of the term represented by $(1-P_{(n-1)})$ for a representative embodiment of a bingo or related game having a Multi-Win feature according to the present disclosure. The values in the table corresponding to calls 24 through 27 are actually slightly less than the 1.0 shown in the table, but have been rounded. For example, the actual value of the $(1-P_{(n-1)})$ term for n=24 is $(1-3.879\times10^{-20})$. However, as explained in greater detail below, this does not significantly impact the overall or aggregate cost of a practical game.

| Ball Calls | | $(1 - P_{(n-1)})$ |
|---|---|---|
| 24 | or less | 1.000000000000000 |
| 25 | exactly | 1.000000000000000 |
| 26 | exactly | 1.000000000000000 |
| 27 | exactly | 1.000000000000000 |
| 28 | exactly | 0.999999999999999 |
| 29 | exactly | 0.999999999999996 |
| 30 | exactly | 0.999999999999982 |
| 31 | exactly | 0.999999999999921 |
| 32 | exactly | 0.999999999999694 |
| 33 | exactly | 0.999999999998912 |
| 34 | exactly | 0.999999999996409 |
| 35 | exactly | 0.999999999988902 |
| 36 | exactly | 0.999999999967630 |
| 37 | exactly | 0.999999999910360 |
| 38 | exactly | 0.999999999763096 |
| 39 | exactly | 0.999999999399842 |
| 40 | exactly | 0.999999998537115 |
| 41 | exactly | 0.999999996557919 |
| 42 | exactly | 0.999999992159704 |
| 43 | exactly | 0.999999982668819 |
| 44 | exactly | 0.999999962737961 |
| 45 | exactly | 0.999999921927156 |
| 46 | exactly | 0.999999840305546 |
| 47 | exactly | 0.999999680611091 |
| 48 | exactly | 0.999999374530054 |
| 49 | exactly | 0.999998799097703 |
| 50 | exactly | 0.999997736761056 |

As indicated in the above table, even at 50 calls, the $(1-P_{(n-1)})$ term is 0.9999977, which is only 0.00000231 less than 1. Of course, the multiplicative identity requires that the product of any number and unity is that number. This effectively explains the difference or lack thereof between the probabilities associated with the prior art style of play and the Multi-Win style according to embodiments of the present disclosure, i.e. because the only difference in the computations is associated with the $(1-P_{(n-1)})$ term, which is essentially equal to one, the difference in theoretical cost is negligible for many practical scenarios. Of course, at some point the probability of a winner would become large enough that it would have a material impact on the overall cost of the different methods of play. However, this is effectively self-governing. Once the odds are such that they materially impact the overall cost differential, the related payouts become so small, or the cost becomes so large, that they become impractical to offer in an actual game.

The no-split payouts provided by various embodiments according to the present disclosure are not inconsequential. Traditional bingo games generally split prizes among multiple winners for a given call. The pure mathematical approach to the cost of the prize according to the present disclosure makes this operating practice obsolete. As demonstrated above, the theoretical cost per ticket is the same regardless of how many tickets are issued or how many winners there are for a single game or call. According to the present disclosure, the game should be continued and all cards that satisfy a particular winning criterion should be awarded the full amount of the prize without any splits, assuming the operator has a sufficient bankroll to maintain long-term operation and absorb natural short-term statistical variation.

Figure 3:
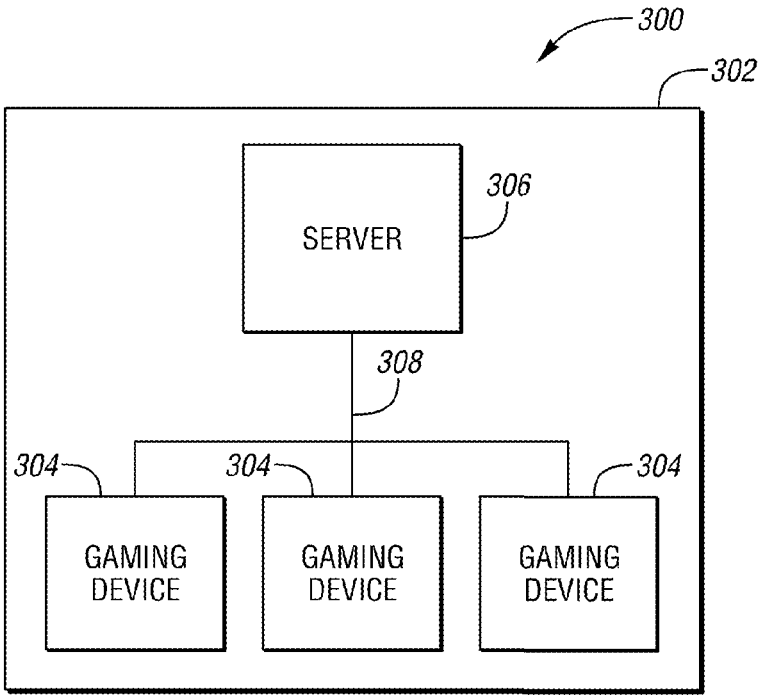
FIG. 3 is a block diagram illustrating a system including a plurality of gaming devices for use in playing a game of chance according to various embodiments of the present disclosure.

FIG. 3 is a block diagram of a system 300 that may be used to execute methods described herein to play one or more games of chance, such as Multi-Win bingo or related games. The games of chance may be played by a player against other players, or may be played by the player against the house. System 300 and/or components thereof may be incorporated within and/or used with other systems and methods described herein.

System 300 may be operated using components and devices within one or more gaming establishments 302 or other suitable locations. Gaming establishments 302 may be, for example, casinos, racetracks, bingo halls, or any other establishments. In one embodiment, one or more gaming devices 304 are positioned within gaming establishment 302 to play or operate the game of chance.

In one embodiment, gaming establishment 302 includes a game server 306 coupled to a plurality of gaming devices 304 through a network 308, such as a private local area network (LAN) within gaming establishment 302. It should be recognized that any number of gaming devices 304 may be located in separate gaming establishments 302, or within the same gaming establishment 302.

In one embodiment, game server 306 is a server computer (or "server") that monitors and controls the games played on gaming devices 304. In addition, game server 306 may administer other background tasks that enable games to be played on gaming devices 304. For example, game server 306 may facilitate authenticating gaming devices 304 and the players using gaming devices 304, and may facilitate allocating payments or credits between players and the house. In addition, game server 306 may interface with a player reward server to facilitate tracking and administering player rewards.

In one embodiment, game server 306 may enable gaming devices 304 connected to game server 306 to participate in one or more games that share one or more progressive or pari-mutuel prizes with other gaming establishments 302 and/or gaming devices 304. While progressive prizes are described in embodiments herein, it should be recognized that pari-mutual prizes may be substituted as desired, and vice versa.

Gaming devices 304 may include one or more kiosks, electronic gaming machines (EGMs) (also known as "slot machines"), desktop computers, or mobile gaming devices. Mobile gaming devices 304 may include, without limitation, cellular phones, tablet computing devices, and/or laptops. Mobile gaming devices 304 may connect to game server 306 and network 308 via a wireless data network. For example, mobile gaming devices 304 may connect to network 308 (and thereby to game server 306) via a "3G" or a "4G" wireless data network, and/or by a wireless Ethernet network.

In one embodiment, during play of a game of chance such as bingo, players may be awarded one or more prizes for completing a pattern and/or completing a portion of the pattern. Accordingly, more winners may be produced than in other games of chance known in the art.

One method of implementing the game of chance includes offering prizes to players that almost achieve a winning pattern in a pre-defined number of ball calls. The following example is for a bingo coverall:

| Ball Call | 1 Away | 2 Away | 3 Away | 4 Away | 5 Away | 6 Away | 7 Away |
|---|---|---|---|---|---|---|---|
| 50 | $1,000 | $100 | $10 | $4 | $3 | $2 | $1 |

In this illustration, prizes would be paid to players that are 1, 2, 3, 4, 5, 6, or 7 numbers "away" from completing the winning pattern once the $50^{th}$ number has been called. As used herein, the term "away" or "away from" refers to the number of balls or indicia within a pattern that have not been matched by the called house indicia or balls. Accordingly, a 1 Away pattern match refers to an occurrence of all balls or indicia within the pattern, except 1, being matched by the called balls or house indicia.

In another embodiment, the prizes for almost completing a winning pattern could be combined with a prize for completing the winning pattern as depicted below.

| Ball Call | Coverall | 1 Away | 2 Away | 3 Away | 4 Away | 5 Away | 6 Away | 7 Away |
|---|---|---|---|---|---|---|---|---|
| 50 | $5,000 | $1,000 | $100 | $10 | $4 | $3 | $2 | $1 |

For a coverall game, the prize structure could be extended all the way to 23 numbers away from matching the winning pattern since there are 24 numbers on a standard bingo card. The following pay table provides two illustrative prize groups for an American style bingo game for 48 numbers or other indicia drawn.

| | Prize A | Prize B |
|---|---|---|
| Bingo | 50,000 | 50,000 |
| 1 Away | 25,000 | 20,000 |
| 2 Away | 10,000 | 10,000 |
| 3 Away | 5,000 | 5,000 |
| 4 Away | 4,000 | 3,000 |
| 5 Away | 3,000 | 2,000 |
| 6 Away | 2,000 | 1,000 |
| 7 Away | 1,000 | 100 |
| 8 Away | 900 | 50 |
| 9 Away | 800 | 40 |
| 10 Away | 700 | 30 |
| 11 Away | 600 | 20 |
| 12 Away | 500 | 10 |
| 13 Away | 400 | 5 |
| 14 Away | 300 | 1 |
| 15 Away | 200 | 5 |
| 16 Away | 100 | 10 |
| 17 Away | 90 | 20 |
| 18 Away | 80 | 30 |
| 19 Away | 50 | 40 |

-continued

| | Prize A | Prize B |
|---|---|---|
| 20 Away | 40 | 500 |
| 21 Away | 10 | 5,000 |
| 22 Away | 5 | 10,000 |
| 23 Away | 1 | 20,000 |

A similar method of extending the prize structure or pay table to include all Away prizes may be applied to a European style bingo game as illustrated below.

| | Prize A | Prize B |
|---|---|---|
| Full House | 50,000 | 25,000 |
| 1 Away | 25,000 | 10,000 |
| 2 Away | 10,000 | 5,000 |
| 3 Away | 5,000 | 3,000 |
| 4 Away | 4,000 | 2,000 |
| 5 Away | 3,000 | 1,000 |
| 6 Away | 2,000 | 500 |
| 7 Away | 1,000 | 200 |
| 8 Away | 900 | 50 |
| 9 Away | 700 | 20 |
| 10 Away | 500 | 1 |
| 11 Away | 300 | 100 |
| 12 Away | 200 | 1,000 |
| 13 Away | 50 | 3,000 |
| 14 Away | 10 | 5,000 |

The same methods of extending prize structures or pay tables to include prizes for almost matching a pattern may be applied to any bingo pattern or combination of numbers on bingo card as illustrated by the following examples for a large picture frame pattern which includes matching all the numbers around the outer edge of a bingo card. The first example includes various prizes awarded for almost completing the pattern (e.g., for achieving a 1 Away pattern match, a 2 Away pattern match, etc.).

| Ball Call | Picture Frame | 1 Away | 2 Away | 3 Away | 4 Away | 5 Away | 6 Away | 7 Away |
|---|---|---|---|---|---|---|---|---|
| 30 | N/A | $20,000 | $5,000 | $500 | $50 | $10 | $3 | $2 |

As with the other embodiments described above, a prize for completing a pattern may be included with the prizes for almost completing the pattern as shown below.

| Ball Call | Picture Frame | 1 Away | 2 Away | 3 Away | 4 Away | 5 Away | 6 Away | 7 Away |
|---|---|---|---|---|---|---|---|---|
| 30 | $50,000 | $20,000 | $5,000 | $500 | $50 | $10 | $3 | $2 |

Similar methods of game play (e.g., extending the prize structure or pay table to include prizes for all Away pattern match embodiments) may also be applied to European style bingo games as illustrated below.

| Ball Call | Single Bingo | 1 Away | 2 Away | 3 Away | 4 Away |
|---|---|---|---|---|---|
| 7 | N/A | $1,000 | $100 | $10 | $4 |

| Ball Call | Double Bingo | 1 Away | 2 Away | 3 Away | 4 Away | 5 Away | 6 Away |
|---|---|---|---|---|---|---|---|
| 20 | N/A | $5,000 | $1,000 | $100 | $10 | $3 | $1 |

| Ball Call | Full House | 1 Away | 2 Away | 3 Away | 4 Away | 5 Away | 6 Away | 7 Away |
|---|---|---|---|---|---|---|---|---|
| 30 | N/A | $20,000 | $10,000 | $1,000 | $100 | $10 | $5 | 3 |

The fee or wager for participating in the games of chance described above may be structured as a separate wager or packaged in the price of a series of games. If a winning pattern has not been achieved in the prescribed number of calls, players that win prizes for almost completing a winning pattern could be allowed to continue to play their card and possibly win another prize for matching additional portions of the pattern and/or for completing the winning pattern. This would allow players the opportunity to win two or more prizes on a single bingo card.

As with the American style game, the prizes for European style bingo may include prizes for completing the winning pattern along with prizes for almost completing the winning pattern (i.e., achieving an Away pattern match) as shown below.

| Ball Call | Single Bingo | 1 Away | 2 Away | 3 Away | 4 Away |
|---|---|---|---|---|---|
| 7 | $5,000 | $1,000 | $100 | $10 | $4 |

| Ball Call | Double Bingo | 1 Away | 2 Away | 3 Away | 4 Away | 5 Away | 6 Away |
|---|---|---|---|---|---|---|---|
| 20 | $10,000 | $5,000 | $1,000 | $100 | $10 | $3 | $1 |

| Ball Call | Full House | 1 Away | 2 Away | 3 Away | 4 Away | 5 Away | 6 Away | 7 Away |
|---|---|---|---|---|---|---|---|---|
| 30 | $50,000 | $20,000 | $10,000 | $1,000 | $100 | $10 | $5 | 3 |

The bingo prizes may be coupled with Multi-Win style prizes described above by offering tiered prizes based on the ball call at which the winning pattern is achieved along with prizes for almost achieving the winning pattern as shown below.

| Ball Calls | | Bingo | 1 Away Prize | 2 Away Prize |
|---|---|---|---|---|
| 49 | or less | 20,000 | 2,000 | 1,000 |
| 50 | exactly | 5,000 | 1,000 | 500 |
| 51 | exactly | 4,000 | 500 | 250 |
| 52 | exactly | 3,000 | 300 | 100 |
| 53 | exactly | 2,000 | 50 | 30 |
| 54 | exactly | 1,000 | 25 | 10 |

There are different methods of offering the tiered prize structure as depicted below. In a first embodiment, the 1 Away and 2 Away prizes may only be made available if at least one card in the game achieves a winning pattern. For example, using the pay table example shown above, if one or more cards achieve a winning pattern on the 50th ball call, players having cards with the winning pattern ("winning cards") would each be paid $5,000. Additionally, players that have cards that are 1 Away would be paid $1,000 and players with cards that are 2 Away would be paid $500. This arrangement is unique in that the 1 Away and 2 Away prizes are only made available if another card in the game (e.g., a card being played by another player) achieves the winning pattern. In the example according to the pay table shown above, the game would effectively end once there is a winning bingo or after the 54th ball is drawn in the example described above.

The method of game play described in the first embodiment in which the 1 Away, 2 Away, etc., prizes are only made available if another card in the game achieves a winning pattern has interesting characteristics. Assume that prizes are grouped as either being bingo prizes (or winning prizes) for achieving the winning pattern and "Away" prizes for being 1, 2, 3, etc., away from completing the winning pattern. The probability of a player winning a bingo prize is directly proportionate to the number of bingo tickets or bingo faces being played. However, the probability of that same player winning an Away prize is dependent on the number of bingo tickets or bingo faces being played by the player and the number of tickets being played by other players. The reason that the total number of tickets being played is relevant is it affects the probability that there will be a bingo. So, for this type of game, a player's chances of winning vary depending on how many tickets the player has and how many total tickets are being played by all the players in the game.

In a second embodiment, the prizes shown in the pay table above may be offered for any card that achieves the winning pattern, or for any card that is 1 Away or 2 Away in the prescribed number of ball calls. In this method of play, at least 54 balls would be drawn for each game. In addition, the 1 Away and 2 Away prizes are not contingent on having another card achieve a winning pattern.

In a third embodiment, the prizes may be offered in the Multi-Win style of play in which at least 54 numbers may be drawn and the 1 Away and 2 Away prizes are only made available if there is at least one card that achieves the winning pattern. For example, if one or more cards achieve a winning pattern on the $50^{th}$ ball call, players having those cards would each be paid $5,000. Additionally, players that have cards that are 1 Away would be paid $1,000 and players that have cards that are 2 Away would be paid $500. The game and ball draw would continue. If there are no cards that achieve the winning pattern on the 51st ball, no prizes are paid. If one or more cards achieve a winning pattern on the 52nd ball call, players having those cards would each be paid $3,000. Additionally, players that have cards that are 1 Away would be paid $300 and 2 Away would be paid $100.

In the second and third embodiments described above, players that have the opportunity to claim a 1 Away or 2 Away prizes may be offered various options. A first option enables players to claim their prize and have their card effectively cancelled for any future possible prizes. Accordingly, the game may be continued for other players to allow the other players or player cards to win prizes, but the canceled card would not be able to win any more prizes (i.e., the game would effectively end for the canceled card). A second option enables players to claim their prize and continue to play the card for additional prizes. As an example, if a player wins a 2 Away prize, he or she could continue to play the same card to win a 1 Away or bingo prize for achieving the winning pattern.

In a third option, players may be given a choice of claiming their entire prize for achieving a 1 Away or 2 Away pattern match, or forfeiting a percentage of their prize for the right to continue playing the card for other prizes. For example, if a player is eligible to claim a 2 Away prize on the $49^{th}$ ball call for $1,000, he or she could claim the full prize amount or only take $500 and continue to play the card in hopes of winning a 1 Away or bingo prize for achieving the winning pattern with the remaining ball calls in the game. Any additional pattern matches or partial pattern matches achieved by the player according to the third option would result in additional prizes to be paid along with the original prize that was partially forfeited.

The first, second, and third embodiments (and associated options or variations thereof) described above may also be applied to European style 90 number bingo as illustrated below.

Single Bingo

| Ball Call | Bingo | 1 Away | 2 Away | 3 Away | 4 Away | 5 Away |
|---|---|---|---|---|---|---|
| 12 or less | 5,000 | 500 | 50 | 5 | 2 | 1 |
| 13 exactly | 2,000 | 300 | 25 | 3 | 2 | 1 |
| 14 exactly | 1,000 | 200 | 10 | 2 | 1 | 0.5 |

Double Bingo

| Ball Call | Bingo | 1 Away | 2 Away | 3 Away | 4 Away | 5 Away |
|---|---|---|---|---|---|---|
| 24 or less | 10,000 | 1,000 | 500 | 300 | 200 | 100 |
| 25 exactly | 5,000 | 900 | 400 | 250 | 150 | 75 |
| 26 exactly | 3,000 | 800 | 300 | 200 | 100 | 50 |
| 27 exactly | 2,000 | 600 | 200 | 150 | 75 | 25 |
| 28 exactly | 1,000 | 500 | 100 | 75 | 50 | 10 |

Full House or Triple Bingo

| Ball Call | Bingo | 1 Away | 2 Away | 3 Away | 4 Away | 5 Away |
|---|---|---|---|---|---|---|
| 40 or less | 20,000 | 3,000 | 2,500 | 2,000 | 1,500 | 1,000 |
| 41 exactly | 5,000 | 2,500 | 2,000 | 1,500 | 1,000 | 800 |
| 42 exactly | 4,000 | 2,000 | 1,500 | 1,000 | 750 | 500 |
| 43 exactly | 3,000 | 1,500 | 1,000 | 750 | 500 | 300 |
| 44 exactly | 2,000 | 1,000 | 750 | 500 | 300 | 100 |
| 45 exactly | 1,000 | 750 | 500 | 300 | 100 | 50 |

The prizes for almost completing a pattern may also be extended out to include all possibilities for matching all or portions of the pattern as indicated in FIG. 8 above for a 90 number game and the illustration below for a 75 number coverall in 50 ball calls or less.

| Match | Prize |
|---|---|
| Bingo | 10,000 |
| 1 Away | 2,000 |
| 2 Away | 1,000 |
| 3 Away | 500 |
| 4 Away | 450 |
| 5 Away | 400 |
| 6 Away | 350 |
| 7 Away | 300 |
| 8 Away | 250 |
| 9 Away | 200 |
| 10 Away | 150 |

-continued

| Match | Prize |
|---|---|
| 11 Away | 100 |
| 12 Away | 95 |
| 13 Away | 90 |
| 14 Away | 80 |
| 15 Away | 85 |
| 16 Away | 70 |
| 17 Away | 65 |
| 18 Away | 60 |
| 19 Away | 55 |
| 20 Away | 50 |
| 21 Away | 30 |
| 22 Away | 20 |
| 23 Away | 10 |
| 24 Away | 1 |

Another variation of the embodiments described above may include a pay table structured to award greater prizes for cards that are farthest away from completing a pattern as illustrated below:

| Match | Prize |
|---|---|
| Bingo | 10,000 |
| 1 Away | — |
| 2 Away | — |
| 3 Away | — |
| 4 Away | — |
| 5 Away | — |
| 6 Away | — |
| 7 Away | — |
| 8 Away | — |
| 9 Away | — |
| 10 Away | — |
| 11 Away | — |
| 12 Away | — |
| 13 Away | — |
| 14 Away | 1,000 |
| 15 Away | 5,000 |
| 16 Away | 10,000 |
| 17 Away | 30,000 |
| 18 Away | 40,000 |
| 19 Away | 50,000 |
| 20 Away | 60,000 |
| 21 Away | 70,000 |
| 22 Away | 80,000 |
| 23 Away | 90,000 |
| 24 Away | 100,000 |

All of the embodiments and illustrations described herein may be modified and applied to American style 75 number bingo, European style 90 number bingo, other variations of bingo with different ball sets, other number-based games such as lottery or keno, or other games in which indicia on a player card (also referred to as "player indicia") are matched to house indicia.

It should be recognized that any of the prize structures or pay tables described herein may be offered independently or collectively. For example, a pay table for a bingo game may be configured to award a prize of $5,000 for matching a bingo pattern in 41 balls called along with a 1 Away prize of $2,500 for matching all but one of the balls within the bingo pattern in 41 balls called. Alternatively, the pay table may be configured to award only the 1 Away prize of $2,500, or any other grouping of prizes. The prizes for the games may be offered as an integrated part of a primary game that is available to all participants or may be offered along with an existing primary game as a secondary game for a separate fee.

In some embodiments, prizes for the games may be offered on an aggregate basis in which multiple winners split the prize amount or may be offered in a manner in which all prizes are paid in full to each winner on a no split basis. In addition, pay tables that include prizes for all possible outcomes (e.g., all possible pattern match outcomes) may be arranged to effectively have a pari-mutuel pay-out that ensures a guaranteed winner while offering prizes that are independent of the number of players. Furthermore, any of the games or pay tables may be structured to have progressive prize amounts at one or more of the prize levels.

In another embodiment, games of chance may offer additional fixed or variable bonus prizes in the event of multiple winners. For example, if multiple players match a winning pattern (either on the same ball call or on different ball calls), one or more bonus prizes may be paid to all participants, one or more bonus prizes may be paid to all winning participants, and/or one or more bonus prizes may be paid to all participants who made one or more predefined purchases, such as buying one or more game entries.

By way of example, a bonus prize of $3,000 might be paid to one or more of the groups of participants described above when there are multiple winners of the winning pattern and/or Away prizes. The bonus prize may also be tiered to increase based on the total number of winners for winning patterns and away prizes.

Figure 4:
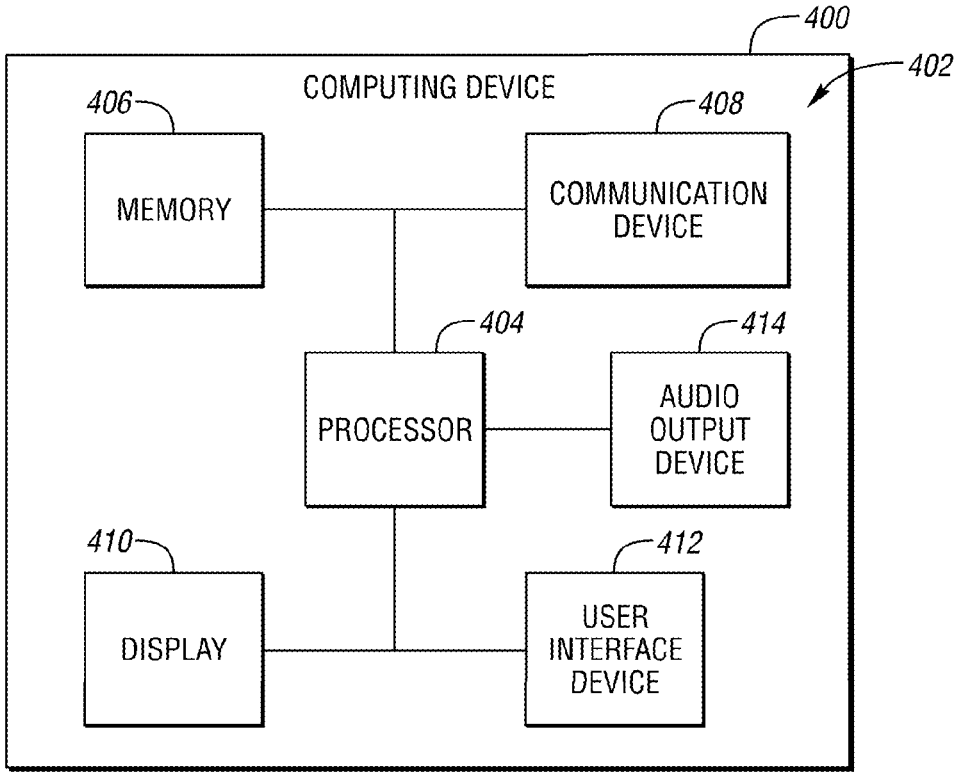
FIG. 4 is a block diagram illustrating a computing device that may be used with the systems and methods described herein.

FIG. 4 is a block diagram of a computing device 400 that may be used with the systems and methods described herein. For example, game server 306, gaming devices 304 (including handheld gaming devices 304), and/or any other devices described in system 100 or system 300 may be implemented as a computing device 400.

Computing device 400 includes a plurality of computing device components 402, such as a processor 404, a computer-readable memory device 406, and a communication device 408. In one embodiment, computing device 400 may also include a display 410, a user interface device 412, and/or an audio output device 414. It should be recognized that memory device 406, communication device 408, display 410, and user interface device 412 (if provided) may be connected to processor 404 and/or to each other via any suitable bus or busses, interfaces, or other mechanisms.

Processor 404 includes any suitable programmable circuit including one or more microcontrollers, microprocessors, application specific integrated circuits (ASICs), systems on a chip (SoCs), programmable logic circuits (PLCs), field programmable gate arrays (FPGAs), and/or any other circuit capable of executing the functions described herein. The above examples are exemplary only, and thus are not intended to limit in any way the definition and/or meaning of the term "processor."

Memory device 406 includes one or more non-transitory computer readable media, such as, without limitation, random access memory (RAM), flash memory, a hard disk drive, a solid state drive, a compact disc, a digital video disc, and/or any suitable memory. Memory device 406 may include data as well as instructions that are executable by processor 404 to program processor 404 to perform functions described herein. For example, the methods described herein may be performed by one or more processors 404 executing instructions stored within one or more memory devices 406.

Communication device 408 may include, without limitation, a network interface controller (NIC) or adapter, a radio frequency (RF) transceiver, a public switched telephone network (PSTN) interface controller, or any other communication device that enables computing device 400 to operate as described herein. In one embodiment, communication device 408 may connect to communication devices 408 of other computing devices 400 of system 100 or system 300 through network 108 or another network using any suitable wireless or wired communication protocol.

Display 410 may include, without limitation, a liquid crystal display (LCD), a vacuum fluorescent display (VFD), a cathode ray tube (CRT), a plasma display, a light-emitting diode (LED) display, a projection display, and/or any suitable visual output device capable of displaying graphical data and text to a user. For example, display 410 may be used to display a graphical user interface to a player or an administrator, one or more images associated with a game such as bingo, keno, or another game of chance, player statistics, gameplay data, player cards, player indicia, and/or any other suitable data.

User interface device 412 may include, without limitation, a keyboard, a keypad, a touch screen, a mouse, a scroll wheel, a pointing device, an audio input device employing speech-recognition software, a video input device that registers movement of a user, and/or any other suitable device that enables the user to input data into computing device 400 and/or retrieve data from computing device 400.

Audio output device 414 may include, without limitation, one or more speakers, or any other device that enables data to be audibly output from computing device 400. For example, gameplay data and/or music may be audibly output from audio output device 414. In addition, if the player wins a prize, audio output device 414 may be used to alert the player and/or others about the win.

While the foregoing computing device components 402 have been described as being included within a computing device 400, it should be recognized that at least some computing devices 400 may not include each component 302. For example, a computing device 400 may not include audio output device 414 and/or other components. In addition, a computing device 400 may include any suitable number of each individual computing device component 302. For example, a computing device 400 may include a plurality of processors 404 or processor cores and/or a plurality of memory devices 406 (of the same or different types, sizes, etc.). In addition, computing device 400 may include a plurality of displays 410, such as a first display 316 and a second display 318. In one embodiment, first display 316 may provide a graphical user interface to a player, and second display 318 may display one or more aspects of gameplay to the player as described more fully herein. Alternatively, first display 316 and second display 318 may display any suitable aspect of the game as desired.

Figure 5:
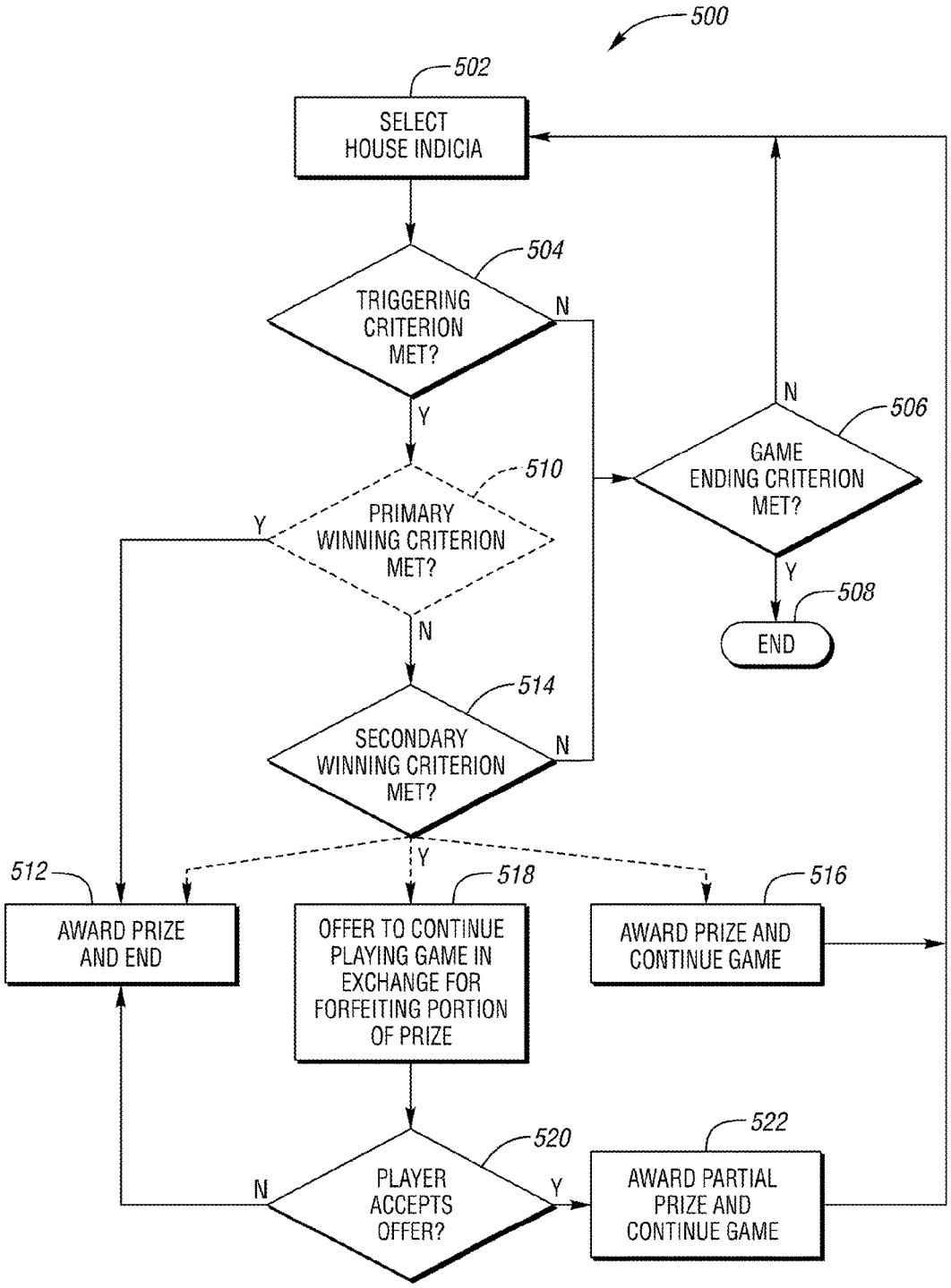
FIG. 5 is a flow diagram illustrating a method of providing a game of bingo or other game of chance according to various embodiments of the present disclosure.

FIG. 5 is a flowchart of a method 500 of providing a game of chance to a player. Method 500 may provide one or more prizes to a player for completing a pattern and/or for completing a portion of a pattern as a result of playing the game. In one embodiment, method 500 may be executed using system 100 (shown in FIG. 1) and/or system 300 (shown in FIG. 3). For example, in one embodiment, method 500 may be executed by game server 306 and/or by one or more gaming devices 304 (e.g., by one or more processors thereof). In some embodiments, method 500 may also be combined with method or system 200, or aspects thereof.

During play of the game of chance, one or more house indicia is selected 502. For example, game server 306, device 120, or another device or system may randomly select one or more numbers or other indicia for use in the game by conducting one or more ball calls. The numbers or other indicia may be selected individually or may be selected in one or more groups.

After each number or other indicia has been selected, method 500 determines 504 whether a triggering criterion is met. The triggering criterion may include, for example, the selection of a prescribed or predefined number of house indicia, the completion of a pattern by another player in the game, an additional wager by the player to unlock a bonus game or additional prizes, or any other suitable condition. The triggering criterion may be used, for example, to initiate a determination of whether the player is eligible to win a prize, such as a prize for matching a portion of a pattern (sometimes referred to as an "away prize"). In embodiments in which the game of chance is played by a plurality of players (with each player having at least one respective player card), the same house indicia are used for each player card and each player card uses the same pattern for determining whether a pattern match occurs.

If the triggering criterion is not met, method 500 determines 506 whether a game ending criterion is met. The game ending criterion may include, for example, the selection of a prescribed or predefined number of house indicia, the completion of a pattern by another player in the game, or any other suitable condition. In some embodiments, the game ending criterion may be the same as the triggering criterion. For example, the game ending criterion and the triggering criterion may both include the selection of all the house indicia prescribed for the game. In another embodiment, the triggering criterion may include the completion of the pattern by another player and the game ending criterion may include the selection of all the house indicia prescribed for the game. It should be recognized, however, that the above-described examples are merely illustrative, and any suitable criterion or criteria may be used for the triggering criterion and the game ending criterion. If the game ending criterion is met, the game ends 508. If the game ending criterion is not met, however, one or more additional house indicia is selected 502.

If the triggering criterion is met 504, method 500 optionally includes determining 510 whether a primary winning criterion is met. In one embodiment, the primary winning criterion is determined 510 even without an occurrence of a triggering criterion, i.e., after each number or other indicia is selected. The primary winning criterion may include, for example, the matching of a predefined pattern by the player (e.g., a winning pattern in embodiments having more than one matchable pattern). Alternatively, the primary winning criterion may include any other suitable criterion.

If the primary winning criterion is determined 510 to be met (e.g., if the player matches the pattern), a prize associated with the matched pattern is awarded 512 to the player and the game is ended. In one embodiment, the prize may be awarded based on the number of house indicia that have been selected and based on the type of pattern matched, for example.

If the primary winning criterion is determined 510 to not be met (e.g., if the player has not yet matched the complete pattern), method 500 includes determining 514 whether a secondary winning criterion is met. The secondary winning criterion may include, for example, the player matching a predetermined portion of the pattern. For example, the secondary winning criterion may be that the player has matched all but 1 of the numbers within the pattern (i.e., a "1 Away" match), all but 2 of the numbers within the pattern (i.e., a "2 Away" match), and/or any other suitable criterion. As a further example, the secondary winning criterion may include achieving any of the partial pattern matches that qualify for prizes on an associated pay table.

If the secondary winning criterion is not met, method 500 determines 506 if the game ending criterion is met. If the game ending criterion is met, the game ends 508. Otherwise, one or more additional house indicia is selected 502 as described above.

If the secondary winning criterion is met, however, method 500 may perform one of three actions (or additional actions may be available if desired). For example, a first action may include awarding 512 a prize associated with the secondary winning criterion and ending the game. Accordingly, if the player achieved a 1 Away partial pattern match within 50 ball calls, the player would receive a prize corresponding to the 1 Away partial pattern match identified in an associated pay table.

A second action that may be performed if the secondary winning criterion is met is awarding 516 a prize associated with the secondary winning criterion and continuing the game to enable the player to match additional numbers within the pattern. For example, if the player achieved a 1 Away partial pattern match within 50 ball calls and 54 ball calls were prescribed to be called during the game, the player may have 4 more ball calls in which to match the final number in the pattern. If the player matches the final number in the pattern, the player would receive an additional prize associated with the complete pattern match. As another example, if the player wins a prize for achieving a 2 Away pattern within 50 ball calls and 54 ball calls were prescribed to be called during the game, the player may have 4 more ball calls in which to match one or both of the remaining numbers within the pattern. In such an example, the player may be able to win prizes for the 2 Away pattern match, the 1 Away pattern match, and the complete pattern match if the player matches the remaining numbers in the pattern with the called house indicia. Alternatively, one or more prizes for achieving partial pattern matches may be subsumed by a prize for a more complete pattern match. For example, a 2 Away prize may be subsumed by a 1 Away prize, and a 1 Away prize may be subsumed by a prize for a complete pattern match.

In an alternative embodiment, the game may be continued past the prescribed number of ball calls for only those players who have met the secondary winning criterion. In such an embodiment, only the players who have met the secondary winning criterion may play to win further prizes as described above.

A third action that may be performed if the secondary winning criterion is met is determining that the player is eligible to win an associated prize and offering 518 to continue playing the game in exchange for the player forfeiting a portion of the prize. If the player accepts 520 the offer, the remaining or partial prize (i.e., the portion of the prize that was not forfeited) may be awarded 522 to the player and the game continues to enable the player to win additional prizes. If the player does not accept the offer, the full prize for the secondary winning criterion is awarded 512 to the player and the game ends.

As an example of how the offer may work, if the player achieved a 1 Away pattern match within 50 ball calls and 54 ball calls were prescribed to be called during the game, the player may be offered the choice of taking or "cashing out" the full amount of the prize and ending the game, or forfeiting a portion (such as 50% or 75%) of the prize in exchange for conducting 4 more ball calls in which to match the final number in the pattern. If the player matches the final number in the pattern, the player would receive an additional prize associated with the complete pattern match. As another example, if the player achieved a 2 Away pattern match within 50 ball calls and 54 ball calls were prescribed to be called during the game, the player may be offered the choice of taking the full amount of the prize and ending the game, or forfeiting a portion of the prize in exchange for conducting 4 more ball calls in which to match one or both of the remaining numbers in the pattern. The player may win an additional prize for matching each additional number of the pattern in this example. As described above, however, one or more prizes for partial pattern matches may alternatively be subsumed by a prize for a more complete pattern match.

It should be recognized that in some embodiments in which a plurality of players play the game using respective player cards, prizes may be awarded for each player card that achieves a partial pattern match and/or a complete pattern match identified on an associated pay table in accordance with the embodiments described herein. Accordingly, multiple players may be awarded 1 Away prizes, 2 Away prizes, prizes for the complete pattern match, and/or any other suitable prize based on the number of player indicia matched by the selected house indicia. The prizes for one or more partial pattern matches may be awarded in addition to the prize for the complete partial pattern match, or may be awarded even if no player (or player card) achieves a complete pattern match during the game.

While the above-described embodiments generally refer to matching a single pattern, or a portion thereof, to win one or more prizes, it should be recognized that multiple patterns may be used with the described embodiments. For example, in some embodiments, prizes may be offered for a player completing or matching any Single, Double, Triple, and Full House patterns during a single game. As another example, prizes may be offered for completing or matching any Four Corners, Letter X, Large Picture Frame, and Coverall patterns during the same game. The examples described above are merely exemplary, and it should be recognized that any suitable patterns and/or partial patterns may be available during the game. Prizes may also be awarded for partially completing the patterns in a similar manner as described above. In some embodiments, players may be given the opportunity to buy tickets and/or enter wagers for a chance to complete single patterns, multiple patterns, and/or partial patterns as desired.

While one or more embodiments have been illustrated and described, it is not intended that these embodiments illustrate and describe all possible embodiments within the scope of the claims. The words used in the specification are words of description rather than limitation, and various changes may be made without departing from the spirit and scope of the disclosure. While various embodiments may have been described as providing advantages or being preferred over other embodiments or prior art implementations with respect to one or more desired characteristics, as one skilled in the art is aware, one or more features or characteristics may be compromised to achieve desired overall attributes, which depend on the specific application and implementation. These attributes include, but are not limited to: cost, strength, durability, life cycle cost, marketability, appearance, packaging, size, serviceability, weight, manufacturability, ease of assembly, distribution, etc. The embodiments described as less desirable than other embodiments or prior art implementations with respect to one or more characteristics are not outside the scope of the disclosure and may be desirable for particular applications or implementations.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to describe embodiments of the disclosure, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine-implemented method for implementing a bingo game in which player indicia on a player card are matched to house indicia selected during the bingo game, the method comprising the steps of:

receiving from at least one player playing an electronic bingo device comprising a bingo device controller, a wager accepting device configured to accept an item having associated monetary value to increase a credit balance associated with said electronic bingo device, and at least one electronic display, an input to purchase at least one player bingo card from said credit balance associated with said player's electronic bingo device;

transmitting, from a bingo game server to said electronic bingo device, information regarding said at least one player bingo card purchased by said at least one player, each of said player bingo cards having a plurality of spaces with associated player indicia;

designating, by said bingo game server, a predetermined winning combination comprising a number of spaces corresponding to said spaces of said at least one player bingo card;

displaying each of said player's bingo cards by said at least one electronic display of the player's bingo device;

generating, via said bingo game server, a plurality of house indicia;

transmitting information regarding said plurality of house indicia to said electronic bingo device;

displaying said plurality of house indicia via said at least one electronic display of said electronic bingo device;

determining, at said bingo game server, whether a triggering criterion is met during the bingo game;

determining, at said bingo game server, each player bingo card which achieved a near winning number of matches upon a determination that said triggering criterion is met, said near winning number of matches comprising matching the selected house indicia with the player indicia associated with a predetermined minimum number of any of the spaces of, but not all of the spaces of, said predetermined winning combination, regardless of the location of the spaces of the predetermined winning combination which are matched; and awarding a first prize for each player card which achieved a near winning number of matches.

2. The method of claim 1 wherein the triggering criterion comprises completing said predetermined winning combination relative to one of said player cards.

3. The method of claim 2, further comprising awarding a second prize for achieving the predetermined winning combination that is different than the first prize for achieving the near winning number of matches.

4. The method of claim 1 wherein the triggering criterion includes completing the generation and display of a predetermined number of house indicia.

5. The method of claim 1, wherein at least one bonus prize is awarded if a predetermined number of said player cards win one of said first prizes.

6. The method of claim 5, wherein an amount of the at least one bonus prize is based on the number of player cards that win said first prize.

7. The method of claim 1, comprising:

awarding a second prize for each player card that achieves a complete combination match after a number of house indicia is selected that is less than or equal to a first number of house indicia, wherein the complete combination match is achieved by matching each player indicia within the predetermined winning combination with the selected house indicia; and awarding at least one third prize for each player card that achieves the complete combination match after each house indicia is selected up to and including a second number of house indicia.

8. The method of claim 1, wherein said predetermined number comprises all but one of said spaces of said predetermined winning combination.

9. The method of claim 1, wherein said step of awarding a first prize comprises transmitting information from said bingo game server to said electronic bingo device corresponding to the player with a player card having a near winning number of matches which causes said credit balance at said electronic bingo device to increase.

10. A bingo gaming system comprising:

at least one electronic bingo device playable by a player, said electronic bingo device comprising a bingo device controller, a wager accepting device configured to accept an item having associated monetary value to increase a credit balance associated with said bingo device, and at least one electronic display, and at least one input device for a player of said electronic bingo device to purchase, using credit from said credit balance, at least one player bingo card;

a bingo game server in communication with said at least one electronic bingo device;

said bingo game server configured to transmit to said at least one electronic bingo device, information regarding said player bingo cards purchased by said player thereof, each of said player bingo cards having a plurality of spaces with associated player indicia;

said at least one electronic bingo device configured to display said player's bingo cards by said at least one electronic display of the player's electronic bingo device;

said bingo server configured to generate a plurality of house indicia and transmit information regarding said plurality of house indicia to said at least one electronic bingo device;

said at least one electronic bingo device configured to display said house indicia via said at least one electronic display thereof;

said bingo server configured to determine whether a triggering criterion is met during the bingo game;

said bingo server configured to determine each player card which achieved a near winning number of matches upon a determination that said triggering criterion is met, said near winning number of matches comprising matching the selected house indicia with the player indicia associated with a predetermined minimum number of any of the spaces of, but not all of the spaces of, a predetermined winning combination, regardless of the location of the spaces of the predetermined winning combination which are matched; and said bingo server configured to cause said at least two electronic bingo devices to award a first prize for each player card which achieved a near winning number of matches.

11. The system of claim 10 wherein the triggering criterion comprises completing said predetermined winning combination relative to one of said player cards.

12. The system of claim 11, wherein said bingo server is further configured to award a second prize for achieving the predetermined winning combination that is different than the first prize for achieving the near winning number of matches.

13. The system of claim 10 wherein the triggering criterion includes completing the generation and display of a predetermined number of house indicia.

14. The system of claim 10, wherein said bingo server is configured to award at least one bonus prize if a predetermined number of said player cards win a prize.

15. The system of claim 14, wherein an amount of the at least one bonus prize is based on the number of player cards that win a prize.

16. The system of claim 10, wherein is said bingo server is further configured to:

award a second prize for each player card that achieves a complete combination match after a number of house indicia is selected that is less than or equal to a first number of house indicia, wherein the complete combination match is achieved by matching each player indicia within the predetermined winning combination with the selected house indicia; and award at least one third prize for each player card that achieves the complete combination match after each house indicia is selected up to and including a second number of house indicia.

17. The system of claim 10, wherein said predetermined number comprises all but one of said spaces of said predetermined winning combination.

18. The system of claim 10, wherein said bingo server transmits information from said bingo game server to said electronic bingo device corresponding to the player with a player card having a near winning number of matches which causes said credit balance at said electronic bingo device to increase.

* * * * *